US007770990B2

(12) United States Patent
Nagashima

(10) Patent No.: US 7,770,990 B2
(45) Date of Patent: Aug. 10, 2010

(54) INKJET RECORDING APPARATUS

(75) Inventor: Kanji Nagashima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 452 days.

(21) Appl. No.: 11/905,340

(22) Filed: Sep. 28, 2007

(65) Prior Publication Data

US 2008/0079759 A1 Apr. 3, 2008

(30) Foreign Application Priority Data

Sep. 29, 2006 (JP) ..... 2006-269593

(51) Int. Cl.
*B41J 29/38* (2006.01)
*B41J 2/19* (2006.01)

(52) U.S. Cl. ..... 347/10; 347/11; 347/92

(58) Field of Classification Search ..... None
See application file for complete search history.

(56) References Cited

U.S. PATENT DOCUMENTS 5,155,498 A * 10/1992 Roy et al. ..... 347/11
5,298,923 A 3/1994 Tokunaga et al.
7,618,128 B2 * 11/2009 Mataki ..... 347/68

FOREIGN PATENT DOCUMENTS

JP 55-71567 A 5/1980
JP 61-227061 A 10/1986
JP 63-94848 A 4/1988
JP 63-295267 A 12/1988

* cited by examiner

*Primary Examiner*—Omar Rojas
(74) *Attorney, Agent, or Firm*—Birch, Stewart, Kolasch & Birch, LLP

(57) ABSTRACT

An inkjet recording apparatus includes a circulation flow channel connected to nozzle flow channels and via which ink from pressure chambers is circulated; actuators which changes pressure in the pressure chambers to eject the ink from the nozzles; and a circulating flow generation device which generates a circulating ink flow from an ink supply port side to a circulation flow channel side. A control apparatus applies ink ejection signals to the actuators for the pressure chambers in which the ink is ejected, the control apparatus also applies, to the actuators for the pressure chambers in which the ink is not ejected, continuous meniscus shaking signals causing the ink in the nozzles to shake to an extent which does not lead the ink to be ejected, wherein the control apparatus thins out the meniscus shaking signals at a plurality of different cycles.

14 Claims, 15 Drawing Sheets

INKJET RECORDING APPARATUS

BACKGROUND OF THE INVENTION

1. Field of the Invention

The present invention relates to an inkjet recording apparatus, and more particularly, to an inkjet recording apparatus in which an air bubble in a flow channel in the vicinity of a pressure chamber which is not ejecting ink is expelled by being caused to vibrate resonantly to be borne away on a circulating flow of ink during printing.

2. Description of the Related Art

An inkjet recording apparatus (inkjet printer) has been known, which comprises an inkjet recording head (ink ejection head) having an arrangement of a plurality of nozzles and which forms images on a recording medium by ejecting liquid droplets of ink from the nozzles of the inkjet recording head toward the recording medium while causing the inkjet recording head and the recording medium to move relatively with respect to each other.

Various methods have been known as ink ejection methods for an inkjet recording apparatus. For example, a piezoelectric method is known, in which a diaphragm which constitutes a portion of each pressure chamber is deformed by the deformation of piezoelectric elements (piezoelectric actuators), thereby changing the volume of each pressure chamber, ink is introduced into each pressure chamber (ink chamber) via an ink supply passage when the volume of each pressure chamber is increased, and the ink in each pressure chamber is ejected from the nozzle in the form of an ink droplet when the volume of each pressure chamber is decreased.

In an inkjet recording apparatus having an inkjet recording head of this kind, ink is supplied to the inkjet recording head from the ink tank storing ink, via an ink supply channel (ink flow channel), and the ink can be ejected by means of various ejection methods. The nozzles of the inkjet recording head are filled with ink at all times in such a manner that printing can be carried out immediately whenever there is a print instruction.

However, if the ink in the head includes air bubbles, ejection defects may occur since the pressure generated in the pressure chambers is absorbed by the air bubbles rather than being transmitted correctly to the ink, and if the ink flow channels become blocked by air bubbles, dirt, or the like, then in the worst case, ejection failures may occur. In cases of this kind, conventionally, the ink is ejected (purged) forcibly by driving the piezoelectric elements, or the like, or the recording head is sealed hermetically with the cap and the ink including air bubbles, dirt, or the like, is suctioned out with a pump. However, during these operations, image recording must be interrupted.

Therefore, it is necessary to eliminate the air bubbles in the ink in the head, as far as possible. Consequently, in the related art, various methods for eliminating air bubbles in the ink have been proposed.

For example, Japanese Patent Application Publication No. 61-227061 discloses an inkjet recording apparatus in which, when the inkjet recording apparatus is not performing a recording operation, a vibration is applied to the ink in the ink flow channels including the nozzles of the recording head of the recording apparatus, in order to remove air bubbles, foreign material, or the like, in the ink flow channels, the energy of the aforementioned vibration being decreased gradually. Furthermore, according to Japanese Patent Application Publication No. 61-227061, the resonance frequency, for instance, of the substrate which constitutes the recording head is desirably used for the signal for excitation, and hence a frequency of 6 kHz to 13 kHz is desirably used for the signal for excitation, for example. Moreover, Japanese Patent Application Publication No. 61-227061 states that the frequency is swept repeatedly through a uniform frequency range.

Furthermore, Japanese Patent Application Publication No. 55-71567, for example, discloses an inkjet recording apparatus in which a vibrating body is provided in an ink supply port, a vibration is applied by the vibrating body to ink which is caused to flow by means of a pressure applied to an ink tank, and air bubbles attached to the inner walls of an external chamber float into the ink due to this vibration and are expelled via air bubble expulsion ports and removed.

Moreover, for example, Japanese Patent Application Publication No. 63-295267 discloses a restoration method for an inkjet recording apparatus in which a head is capped and ink in the liquid channels of the head is suctioned by a pump, while simultaneously the ink is made to vibrate by driving the head by applying a signal to the head driver, thereby making it easier to remove air bubbles which are attached to the inner walls of the liquid channels. During this operation, since the resonance frequencies of the air bubbles in the liquid channels vary according to the size of the air bubbles, then the frequency at which the head is driven is changed (swept).

Furthermore, Japanese Patent Application Publication No. 63-94848, for example, discloses a head protection apparatus for an inkjet printer in which the nozzle section of a head is covered with a cap, and while suctioning ink by means of a pump, air bubbles adhering to the walls of the spray channel system are made to float into the ink by firstly driving the piezoelectric elements of the head at a high frequency, and then gradually lowering (sweeping) the drive frequency to a low frequency range, in other words, a frequency band in which air bubbles floating in the ink collide with the walls of the spray channel system without adhering to the walls, and where cavitation does not occur.

However, in the related art, as described in the various patent references cited above, for example, the composition almost always involves removing air bubbles by capping the nozzles and suctioning with a pump while applying a vibration to the ink in order to detach air bubbles from the walls of the flow channels. In a composition of this kind, it is not possible to use the air bubble removal function during execution of a printing operation, and therefore printing operations have to be interrupted when air bubbles are to be removed.

Consequently, if continuous printing is being carried out by means of a single-pass printer which uses a page-wide full line head, then if the related art technology described above is used, operations for interrupting printing, capping the nozzles and suctioning with a pump are required in order to remove air bubbles, and therefore the productivity declines markedly.

SUMMARY OF THE INVENTION

The present invention has been contrived in view of these circumstances, an object thereof being to provide an inkjet recording apparatus which is also capable of carrying out an air bubble removal operation during a printing operation, without causing productivity to fall.

In order to attain the aforementioned object, the present invention is directed to an inkjet recording apparatus, comprising: pressure chambers connected via nozzle flow channels to nozzles which eject ink; ink supply ports via which the ink is supplied to the pressure chambers; a circulation flow channel which is connected to the nozzle flow channels and via which the ink from the pressure chambers is circulated; actuators which changes pressure in the pressure chambers to eject the ink from the nozzles; a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, continuous meniscus shaking signals causing the ink in the nozzles to shake to an extent which does not lead the ink to be ejected, wherein the control apparatus thins out the meniscus shaking signals applied to the actuators for the pressure chambers in which the ink is not ejected at a plurality of different cycles.

In this aspect of the invention, it is possible to change the shaking frequency of the ink in the pressure chambers, and therefore the air bubble removal characteristics can be improved, and furthermore, the air bubble removal operation can also be carried out even during a printing operation, thereby making it possible to achieve an inkjet recording apparatus which does not suffer decline in productivity.

In order to attain the aforementioned object, the present invention is directed to an inkjet recording apparatus, comprising: pressure chambers connected via nozzle flow channels to nozzles which eject ink; ink supply ports via which the ink is supplied to the pressure chambers; a circulation flow channel which is connected to the nozzle flow channels and via which the ink from the pressure chambers is circulated; actuators which changes pressure in the pressure chambers to eject the ink from the nozzles; a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, meniscus shaking signals each of which includes a plurality of pulse signals within one unit cycle and which cause the ink in the nozzles to shake to an extent which does not lead the ink to be ejected, wherein the control apparatus applies the meniscus shaking signals to the actuators for the pressure chambers in which the ink is not ejected in such a manner that time intervals between the plurality of pulse signals within one unit cycle of each of the meniscus shaking signals are altered sequentially.

In this aspect of the invention, it is possible to change the shaking frequency of the ink in the pressure chambers within a greater range, and therefore the air bubble removal characteristics can be increased.

In order to attain the aforementioned object, the present invention is directed to an inkjet recording apparatus, comprising: pressure chambers connected via nozzle flow channels to nozzles which eject ink; ink supply ports via which the ink is supplied to the pressure chambers; a circulation flow channel which is connected to the nozzle flow channels and via which the ink from the pressure chambers is circulated; actuators which changes pressure in the pressure chambers to eject the ink from the nozzles; a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, meniscus shaking signals each of which include a square wave within one unit cycle and which cause the ink in the nozzles to shake to an extent which does not lead the ink to be ejected, wherein the control apparatus applies the meniscus shaking signals to the actuators for the pressure chambers in which the ink is not ejected in such a manner that duration of the square wave within one unit cycle is altered sequentially.

In this aspect of the invention, the shaking frequency of the ink in the pressure chambers can be changed within a larger range, and furthermore, the larger amplitude can be obtained, thereby making it possible to increase the air bubble removal characteristics.

Preferably, when vibration of the ink caused by controlling the meniscus shaking signals has conditions close to a resonance frequency of the pressure chambers, amplitude of the meniscus shaking signals is reduced in comparison with the amplitude of the meniscus shaking signals at other frequencies.

In this aspect of the invention, it is possible to prevent unintentional ejection caused by the meniscus shaking signals, and at frequencies other than the resonance frequency, a greater vibration can be applied and the air bubble removal characteristics can be improved.

Preferably, the control apparatus applies the meniscus shaking signals to the actuators for the pressure chambers in which the ink is not ejected in such a manner that vibration of a frequency range causing resonance of the pressure chambers including an air bubble in a size range which allows the air bubble to enter into the pressure chambers occurs; and a maximum size of the air bubble is taken to be a mesh size of a filter provided on the ink supply port side, and a minimum size of the air bubble is taken to be a size of a smallest air bubble which has an effect on ejection of the ink.

In this aspect of the invention, by causing the ink to vibrate in a concentrated fashion within a specified frequency range, it is possible to remove air bubbles in a shorter period of time.

In order to attain the aforementioned object, the present invention is directed to an inkjet recording apparatus, comprising: pressure chambers connected via nozzle flow channels to nozzles which eject ink; ink supply ports via which the ink is supplied to the pressure chambers; a circulation flow channel which is connected to the nozzle flow channels and via which the ink from the pressure chambers is circulated; actuators which changes pressure in the pressure chambers to eject the ink from the nozzles; a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, meniscus shaking signals which cause the ink in the nozzles to shake to an extent which does not lead the ink to be ejected, wherein a following relationship is satisfied: (resistance of the ink supply port/resistance of the circulation flow channel)>(inertance of the ink supply port/inertance of the circulation flow channel); and wherein, with respect to the meniscus shaking signals, an absolute value of an average amount of change per unit time when the pressure in the pressure chambers is reduced is made larger than an absolute value of an average amount of change per unit time when the pressure in the pressure chambers is increased.

In this aspect of the invention, it is possible to create a flow which promotes the circulation of ink, and therefore the air bubble removal characteristics are improved by this flow and the air bubbles can be removed in a shorter period of time.

Preferably, high-frequency signals causing the air bubble to vibrate in a high-order mode are applied to the actuators for the pressure chambers in which the ink is not ejected, simultaneously with the meniscus shaking signals.

Preferably, high-frequency signals causing an air bubble in the pressure chambers or in a neighborhood of the pressure chambers to vibrate in a high-order mode are applied to the actuators for the pressure chambers in which the ink is not ejected, simultaneously with the meniscus shaking signals.

In these aspects of the invention, it is possible to promote detachment of air bubbles and dissolution of air bubbles, simultaneously.

As described above, according to the present invention, it is possible to change the shaking frequency of the ink in the pressure chambers, and therefore the air bubble removal characteristics can be improved, and furthermore, the air bubble removal operation can also be carried out during a printing operation, thereby making it possible to achieve an inkjet recording apparatus which does not suffer decline in productivity.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIGS. 8A to 8C are graphs showing a method of applying a meniscus shaking signal, wherein FIG. 8A is an ejection waveform, FIG. 8B is a meniscus shaking signal and FIG. 8C is a selection waveform;

FIGS. 15A to 15C are illustrative diagrams showing a seventh embodiment, in which FIG. 15A shows the state of deformation of an air bubble in the case of normal meniscus shaking, and FIG. 15B and FIG. 15C show cases where the air bubble is shaken in higher-order modes.

DETAILED DESCRIPTION OF THE PREFERRED EMBODIMENTS

Figure 1:
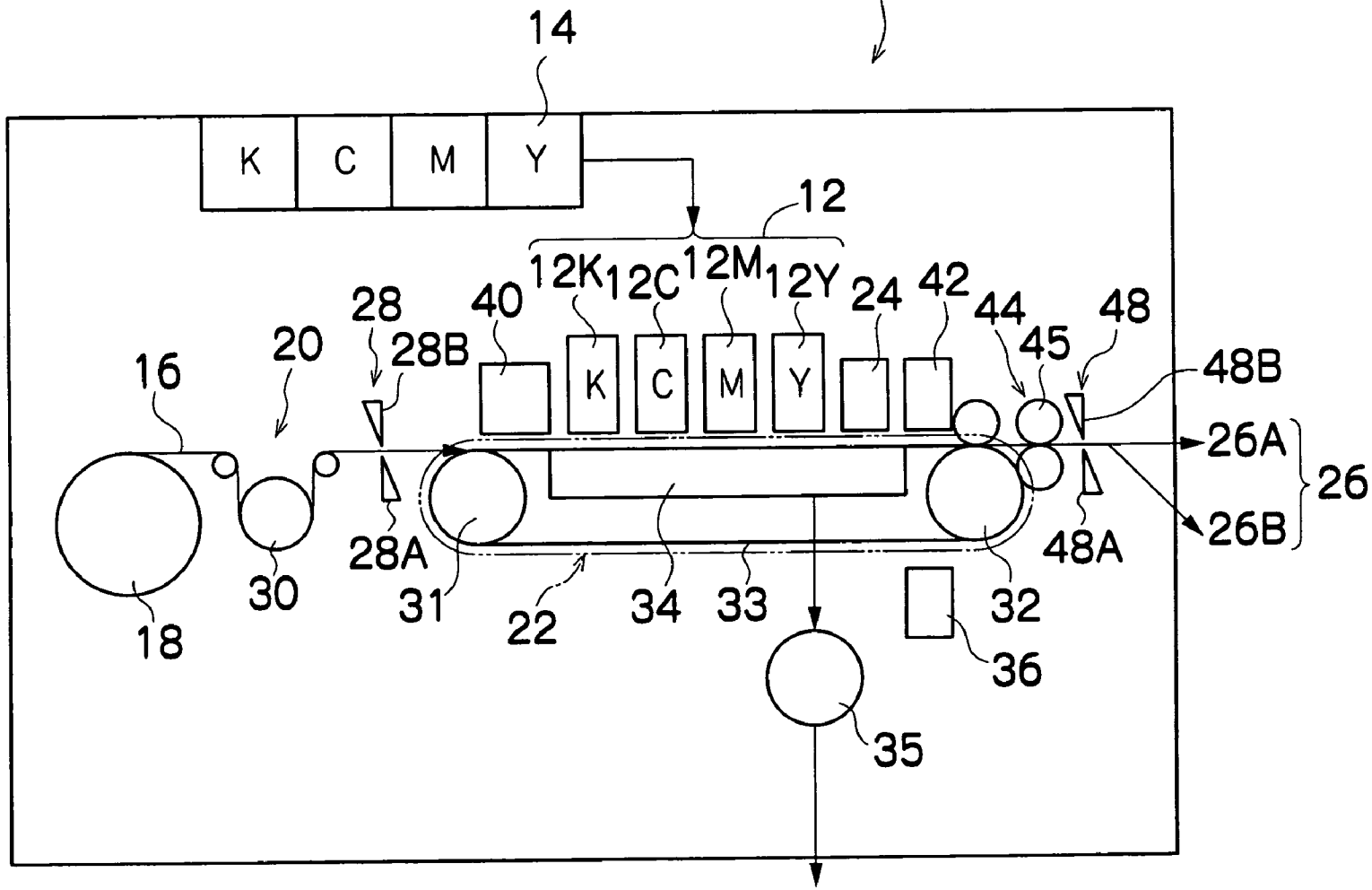
FIG. 1 is a general schematic drawing showing a general view of a first embodiment of an inkjet recording apparatus relating to the present invention.

FIG. 1 is a general schematic drawing showing a general view of a first embodiment of an inkjet recording apparatus relating to the present invention.

As shown in FIG. 1, the inkjet recording apparatus 10 comprises: a print unit 12 having a plurality of print heads (liquid ejection head) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of the configuration in which roll paper is used, a cutter 28 is provided as shown in FIG. 1, and the roll paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink droplet ejection is controlled so that the ink droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30, in the direction opposite to the direction of curl in the magazine. In this, the heating temperature is preferably controlled in such a manner that the paper retains curl in which the print surface of the medium is slightly rounded in the outward direction.

After decurling, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat surface).

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the printing area passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
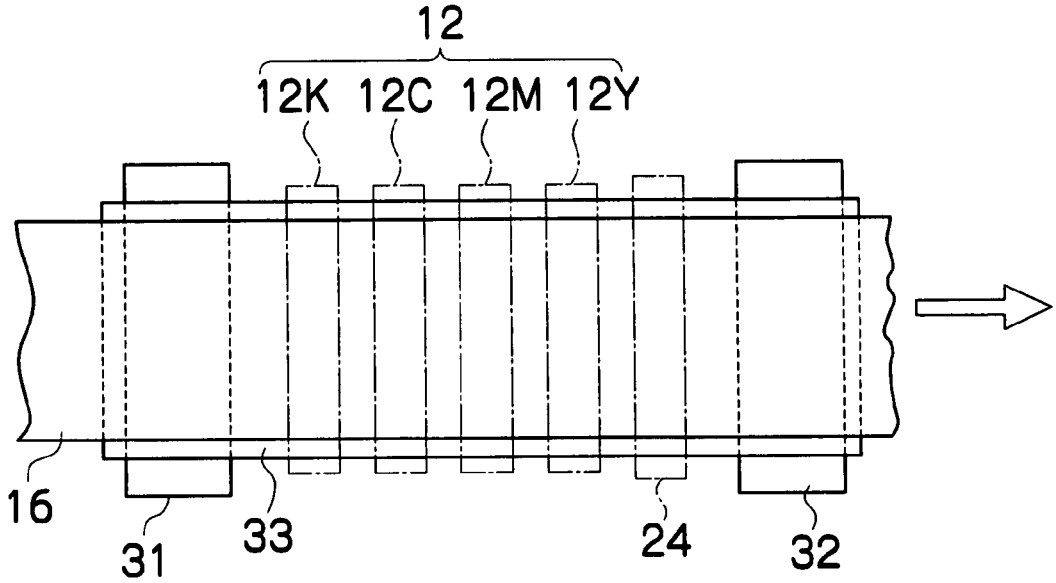
FIG. 2 is a plan view of the principal part of the peripheral area of a print unit in the inkjet recording apparatus illustrated in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

Each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main-scanning direction) that is perpendicular to paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor, and the like) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Figure 3:
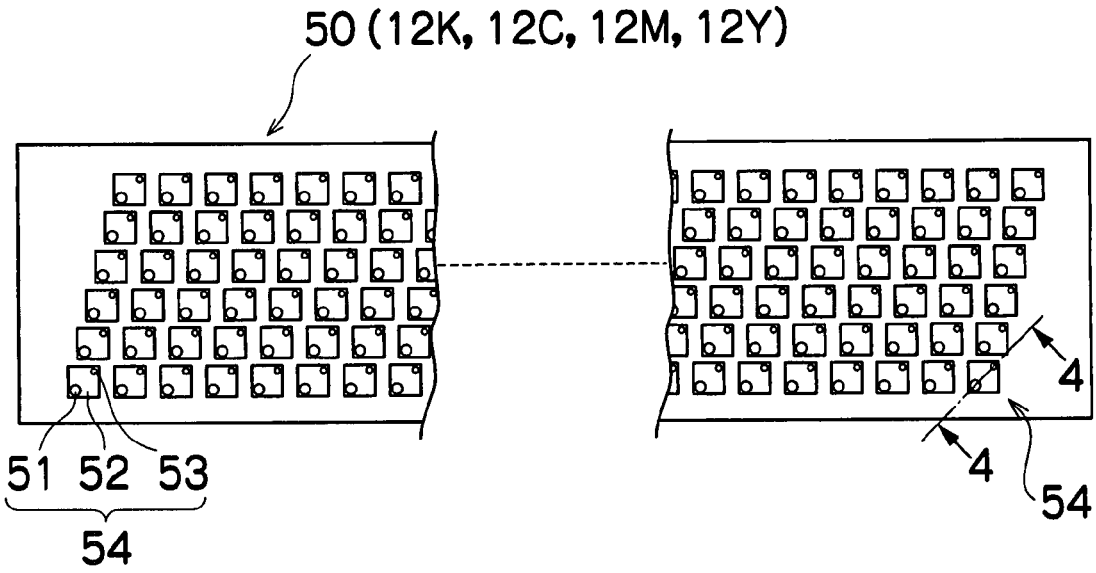
FIG. 3 is a plan perspective diagram showing an example of the structure of a print head.

Next, the arrangement of nozzles (liquid ejection ports) in the print head (liquid ejection head) will be described. The print heads 12K, 12C, 12M and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink in the form of ink droplets, a pressure chamber 52 for applying pressure to the ink in order to eject ink, and an ink supply port 53 for supplying ink to the pressure chamber 52 from a common flow channel (not shown in FIG. 3).

There are no particular limitations on the size of the nozzle arrangement in a print head 50 of this kind, but as one example, 2400 npi can be achieved by arranging nozzles 51 in 48 lateral rows (21 mm) and 600 vertical columns (305 mm).

In the example shown in FIG. 3, the pressure chambers 52 each have an approximately square planar shape when viewed from above, but the planar shape of the pressure chambers 52 is not limited to a square shape. As shown in FIG. 3, a nozzle 51 is formed at one end of the diagonal of each pressure chamber 52, and an ink supply port 53 is provided at the other end thereof.

Figure 4:
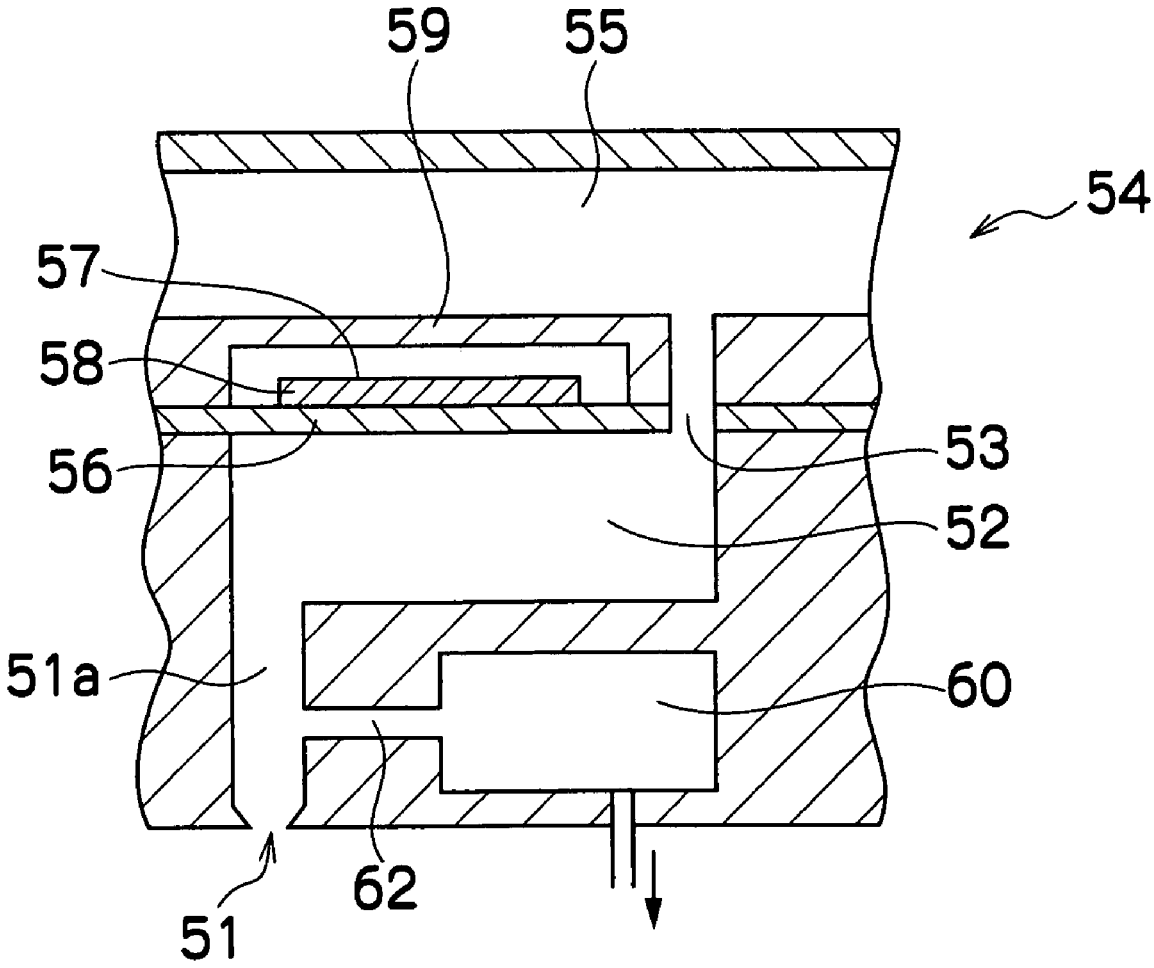
FIG. 4 is a cross-sectional diagram along line 4-4 in FIG. 3.

FIG. 4 is a cross-sectional diagram of a pressure chamber unit 54 along line 4-4 in FIG. 3.

As shown in FIG. 4, piezoelectric elements (PZT elements, piezo actuators) 58 are formed on top of a diaphragm 56 which constitutes the ceiling of the pressure chambers 52. An individual electrode 57 is formed on each piezoelectric element 58, and the diaphragm 56 also serves as a common electrode. The piezoelectric element 58 is driven by applying a drive voltage between the common electrode (diaphragm 56) and the individual electrode 57. By this means, the diaphragm 56 is caused to deform, the volume of the pressure chamber 52 is reduced, and a pressure is applied to the ink in the pressure chamber 52, thereby causing the ink to be ejected from the nozzle 51.

Furthermore, a piezo cover 59 is provided on the upper side of each piezoelectric element 58, in order to protect the piezoelectric elements 58 while ensuring that they can be driven freely. A common flow channel 55 for supplying ink to the pressure chambers 52 is formed on the upper side of the piezo cover 59. The pressure chambers 52 are connected to the common flow channel 55 via ink supply ports 53, and after ink has been ejected and the voltage applied to the piezoelectric element 58 is released, the volume of the pressure chamber 52 returns to the original volume, and new ink is supplied to the pressure chamber 52 from the common flow channel 55 via the corresponding ink supply port 53.

Furthermore, a nozzle flow channel 51*a* which links the pressure chamber 52 with the nozzle 51 is provided with a circulation flow channel 62 which connects a common circulation channel 60 to the nozzle flow channel 51*a*. Each ink supply port 53 may be called the first restrictor, and each circulation flow channel 62 may be called the second restrictor. Furthermore, as indicated by the arrow from the common circulation channel 60 shown in FIG. 4, outside of the printing range of the head, the tubes are extended to circulate the ink via a solvent density detector, and the like, in such a manner that the tubes do not make contact with the recording medium. The ink circulation system including the common circulation channels 60 and the circulation flow channels 62, and the like, is described hereinafter.

Figure 5:
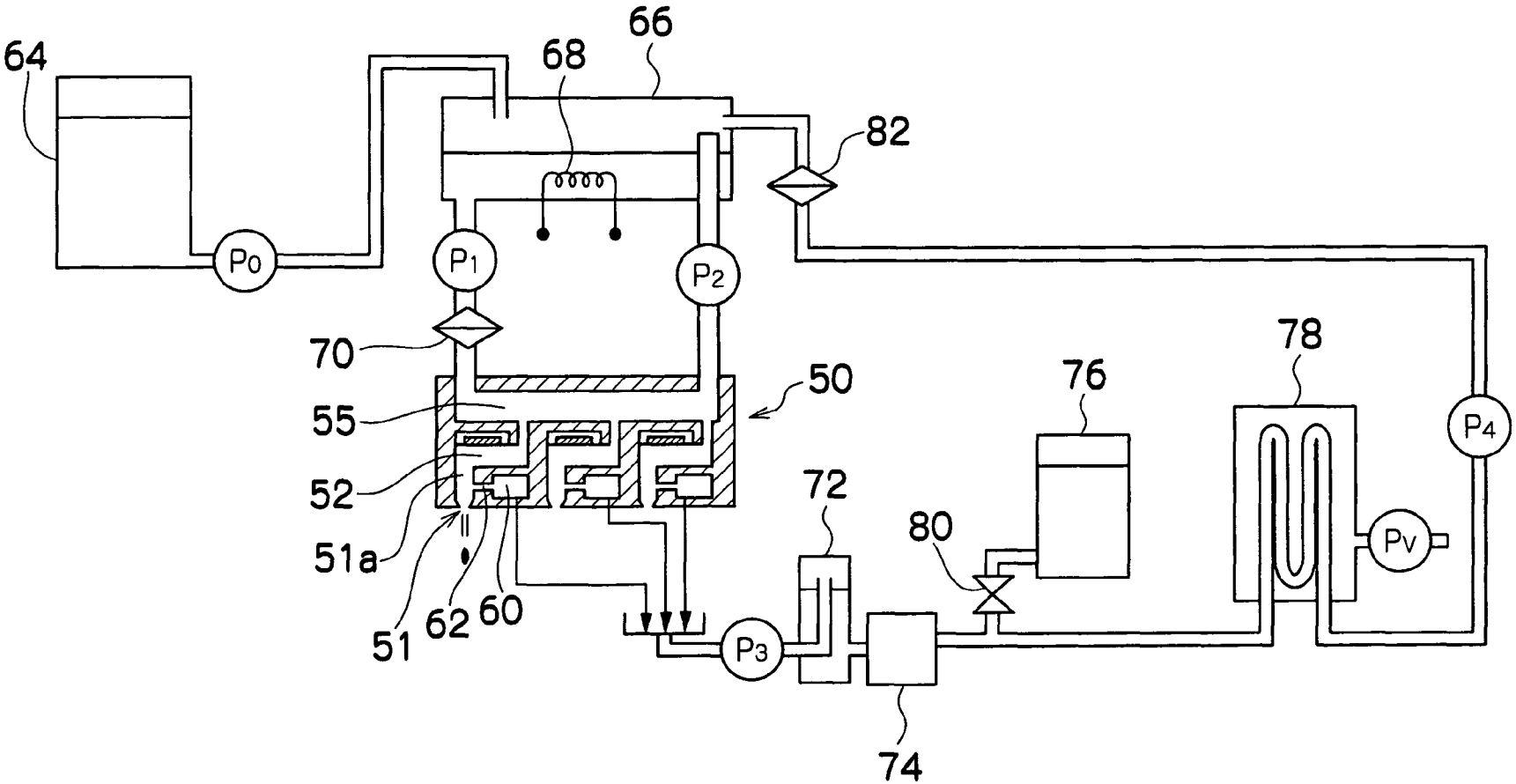
FIG. 5 is a general schematic drawing showing a portion of the print head and an ink supply/ink circulation system.

FIG. 5 is a general schematic drawing showing a portion of a print head 50 and an ink supply/ink circulation path.

As shown in FIG. 5, in order to supply ink to the print head 50, an ink tank 64, a sub tank 66 and pumps P0, P1, P2 are provided.

The ink tank 64 is a base tank that supplies ink to the print head 50 and is set in the ink storing and loading unit 14 described with reference to FIG. 1. The aspects of the ink tank 64 include a refillable type and a cartridge type: when the remaining amount of ink is low, the ink tank 64 of the refillable type is filled with ink through a filling port (not shown) and the ink tank 64 of the cartridge type is replaced with a new one. In the case of changing the ink type in accordance with the intended application, the cartridge type is suitable, and it is preferable to represent the ink type information with a bar code or the like on the cartridge, and to perform ejection control in accordance with the ink type. The ink supply tank 64 in FIG. 5 is equivalent to the ink storing and loading unit 14 in FIG. 1 described above.

Furthermore, the sub tank 66 is provided in the tubing channel which connects the ink tank 64 with the print head 50. The sub tank 66 has a heating/cooling device 68 for adjusting the ink temperature incorporated therein, and the viscosity of ink with a high viscosity is adjusted (reduced) by controlling the temperature of the high viscosity ink to 55° C. based on a temperature sensor (not shown) in the head. Furthermore, the sub tank 66 has functions of improving damping effects in order to prevent variations in the internal pressure in the head as well as improving refilling performance.

The pump P0 is provided between the ink tank 64 and the sub tank 66, and by driving the pump P0, ink is supplied from the ink tank 64 to the sub tank 66. The pump P0 is controlled in such a manner that the volume of ink in the sub tank 66 is uniform.

Ink is supplied from the sub tank 66 to the common flow channel 55 in the print head 50 via a filter 70, by means of the pump P1. The filter 70 is set to have a mesh size some 10% smaller than the diameter of the nozzles 51, thereby removing foreign material and air bubbles and thus preventing nozzle blockages.

Moreover, a further pump P2 is provided between the print head 50 and the sub tank 66, and the ink in the common flow channel 55 is recovered by the pump P2 and returned to the sub tank 66. It is also possible to provide a vacuum deaerator between the pump P2 and the print head 50.

The flow rate per unit time of the ink flowing through the common flow channel 55 is specified in accordance with the pressure differential between the pump P1 and the pump P2, and the resistance of the common flow channel 55. This ink flow rate is a value which can be used to control the temperature change caused by heat generated in the print head 50, and it is set to a flow rate which causes the air bubbles to flow in the ink even if such air bubbles have entered into the common flow channel 55. Both of these conditions can be satisfied if the flow rate is set to a high rate. Although the flow rate must be kept within a range which avoids the occurrence of turbulence in the common flow channel 55, it is possible to set an inkjet head so as to satisfy the conditions described above in terms of the heat generation and dimensions of a general inkjet head.

For example, the effective flow speed is some 10 to 20 times the amount of ink consumed per unit time period when the head is in a state of full ejection (continuous ejection for printing at the maximum frequency and the maximum ejection volume). If a head which ejects 2 pl of ink at 40 KHz has a nozzle density of 1200 npi and a length of 2 inches per unit, then the ink consumption is $2\times2\times1200\times40000$ (pl/sec)=0.192 ml/sec, and therefore the ink flow rate passing through the common liquid channel 55 is approximately 2 to 4 ml/sec. If the head has a nozzle density of 2400 dpi, then the ink volume becomes double this figure.

Furthermore, the pressures of the pumps P1 and P2 are weak negative pressures, in such a manner that the meniscus is pulled in slightly at the nozzles 51 of the print head 50, and the pressure value is −20 $mmH_2O$ to −60 $mmH_2O$ with respect to the atmospheric pressure.

With respect to each pressure chamber 52, the first restrictor (ink supply port 53) which takes in ink from the common flow channel 55 is connected to the nozzle flow channel 51*a* which joins the pressure chamber 52 with the nozzle 51. Furthermore, as stated previously, the thin diaphragm 56, the piezo actuator (piezoelectric element 58) which causes the diaphragm 56 to deform, and wires such as an electrode of the piezo actuator, are installed integrally in the ceiling portion of each pressure chamber 52.

Moreover, a circulation flow channel 62 is connected to the nozzle flow channel 51*a* in order to circulate the ink, and the circulation flow channel 62 is connected to the common circulation channel 60. As shown in FIG. 3 as well, the print head 50 is composed by arranging a plurality of pressure chambers 52 of this kind in the form of rows, and overall the print head 50 is formed to a nozzle density of 1200 npi.

As stated previously, when the diaphragm 56 deforms in a direction which increases the volume of the pressure chamber 52, the meniscus of the ink in the nozzle 51 is pulled in towards the pressure chamber, while at the same time ink is sucked into the pressure chamber 52 via the first restrictor (ink supply port 53). Furthermore, if the diaphragm 56 deforms in a direction which reduces the volume of the pressure chamber 52, then the meniscus of the ink in the nozzle 51 is pushed out. If the time interval between these "pulling" and "pushing" of the meniscus is one quarter of the fluid resonance cycle of the pressure chamber 52 and the ink, then the vibrations caused by the "pull" and "push" combine with each other and a large displacement is obtained. Consequently, it is possible to eject ink readily from the nozzle 51. At the same time, ink is pushed out into the common flow channel 55 via the first restrictor (ink supply port 53).

In this case, the flow rate of the ink flowing toward the nozzle 51 in accordance with the displacement of the diaphragm 56, and the flow rate of the ink flowing toward the first restrictor (ink supply port 53) are determined by the ratio between the resistances and the inertances of the respective flow channels. In a general inkjet head, the dimensions are set in such a manner that this ratio is approximately 1:1.

Furthermore, as shown in FIG. 5, a reservoir 72, a solvent density detector 74, a solvent tank 76 and a deaerator 78 are provided as an ink circulation system which circulates the ink from the print head 50 to the sub tank 66.

The circulation flow channels 62 which link to the nozzle flow channels 51*a*, which are provided for the pressure chambers 52 respectively, are connected to the common circulation channels 60. The ink circulated from the pressure chambers 52 in one pressure chamber row passes along the same common circulation channel 60. The plurality of common circulation channels 60 provided in one head unit are gathered together and connected to a pump P3. Furthermore, the pump P3 is connected to the reservoir 72.

The pump P3 (circulation flow generating device) is set to a more negative pressure compared to the pumps P1 and P2 described above. Due to the pressure differential between the pumps P1, P2 and the pump P3, ink is suctioned into the pressure chambers 52 via the first restrictors (ink supply ports 53), and is made to flow through the pressure chambers 52, the nozzle flow channels 51*a*, the circulation flow channels 62 and the common circulation channels 60. By this means, a circulating ink flow is created. Furthermore, it is also possible to create such a circulating flow by controlling the height of the liquid surface in the sub tank 66, rather than using a pump.

This circulating ink is, for example, set and controlled to the pressure and flow rate described above, in such a manner that, in a nozzle 51 which is performing ejection, ink flows back from the common circulation channel 60, via the circulation flow channel 62 and into the nozzle flow channel 51*a*, thereby forming a portion of the ejected ink.

Furthermore, concerning the ink (circulated ink) in the common circulation channel 60 which has passed in the vicinity of the nozzle, the solvent density declines due to the effects of evaporation of the ink solvent from the nozzle 51. This ink having a decreased solvent density is collected in the reservoir 72, in such a manner that the subsequent processing does not affect the pressure of the pump P3.

The solvent density detector 74 is connected to the reservoir 72 and ink that has entered into the reservoir 72 flows subsequently into the solvent density detector 74, where the solvent density is determined by determining the density, viscosity, flow speed variation and electrical conductivity of the ink, and the like. Consequently, the evaporated amount (shortfall amount) is determined and an amount of solvent for addition to the ink is specified accordingly. The solvent tank 76 is connected to the ink channel after the solvent density detector 74, via a valve 80. The ink viscosity is restored by adding the specified amount of solvent for addition, to the ink, from the solvent tank 76.

The deaerator 78 is connected to the solvent density detector 74, and the amount of dissolved gas in the ink input to the deaerator 78 from the solvent density detector 74 is reduced by means of the deaerator 78, which is connected to a vacuum pump Pv. If a vacuum deaerator is provided before the pump P2, as stated previously, then this deaerator 78 can be omitted.

The circulated ink which has been recycled in this fashion is returned to the sub tank 66 via a filter 82, by a pump P4.

In general, heat is generated in the head section due to the action of the actuators, and therefore it is desirable to use the circulated ink in order to remove this generated heat. Consequently, it is necessary to adjust the temperature of the circulated ink, when it is recycled or resupplied.

In the example described above, the circulated ink which has passed through the pressure chambers 52 and has been recovered via the circulation flow channels 62 and the common circulation channels 60 is recycled and then reused by adding solvent and adjusting the density in order to compensate for the evaporated solvent, by removing air which has dissolved into the ink from the air in the nozzle section, and by removing foreign material by means of the filter 82. However, it is also possible to discard the circulated ink, rather than reusing it, if the amount of circulated ink is low, or depending on the characteristics of the ink.

Below, the first embodiment is described in detail.

Figure 6:
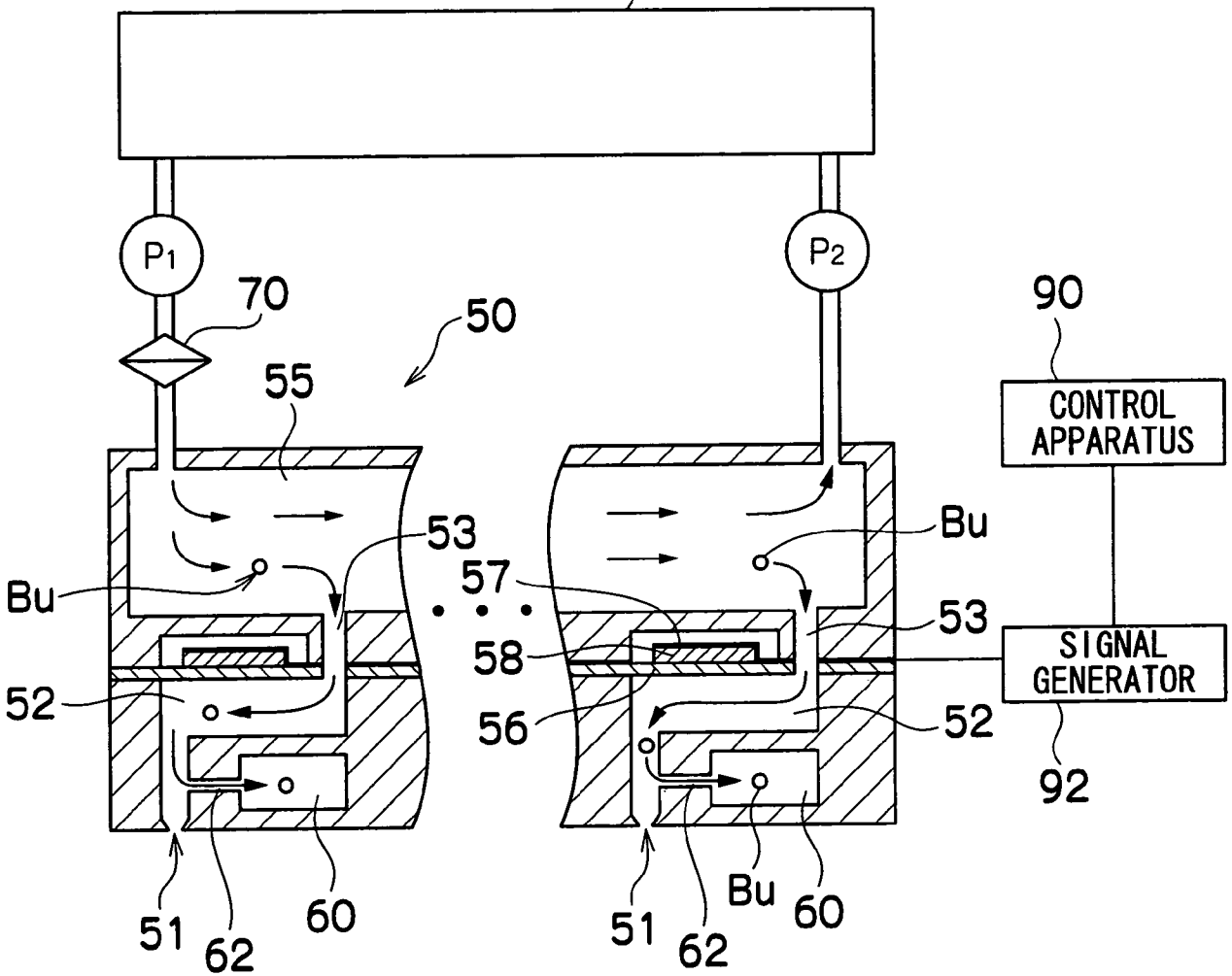
FIG. 6 is an enlarged diagram showing the vicinity of the print head in FIG. 5.

FIG. 6 shows an enlarged view of the vicinity of the print head 50 in FIG. 5. As shown in FIG. 6, the print head 50 according to the present embodiment is composed in such a manner that ink is supplied to each of the pressure chambers 52 via an ink supply port (first restrictor) 53, from the common flow channel 55 which stores ink supplied from the sub tank 66 (ink tank 64), and furthermore, the ink is caused to flow from each of the pressure chambers 52, through a circulation flow channel (second restrictor) 62, and into a common circulation channel 60.

In this case, the ink circulation side (common circulation channel 60) is set to a more negative pressure compared to the ink supply side, in such a manner that a flow of circulating ink is generated. Ink is circulated in the fashion indicated by the arrows in FIG. 6.

In other words, the ink supplied by the pump P1 from the sub tank 66 to the common flow channel 55 via the filter 70 is supplied from the ink supply ports (first restrictors) 53 to the pressure chambers 52. Due to this ink flow, air bubbles Bu in the ink flow from the common flow channel 55 into the pressure chambers 52, and further flow from the nozzle flow channels 51*a*, through the circulation flow channels (second restrictors) 62 and into the common circulation channel 60, where they are collected.

In a basic composition which removes air bubbles by circulating the ink as shown in FIG. 6, it is also possible to circulate the ink directly between the print head and the main ink tank 64, instead of the sub tank 66. Furthermore, in this case, a composition may be adopted in which the pump P2 for returning the ink to the ink tank 64 (66) from the common flow channel 55 is omitted.

In the first embodiment, a meniscus shaking signal which is applied to the piezoelectric element 58 (actuator) for each pressure chamber 52 so as to cause the ink to shake at a frequency (or cycle) and an amplitude which do not give rise to ink ejection, is switched on and off at a prescribed variation cycle. In other words, the cycle of shaking the air bubbles is changed within a prescribed frequency range by thinning out the meniscus shaking signals according to prescribed conditions, thereby causing the air bubbles in the vicinity of the pressure chambers 52 to vibrate and hence to detach from the walls of the pressure chambers 52 and the flow channels in the vicinity of same, in such a manner that the air bubbles can be borne on the flow of circulating ink and expelled.

Firstly the meniscus shaking signals are described below with reference to FIGS. 8A to 8C.

Figure 8A:
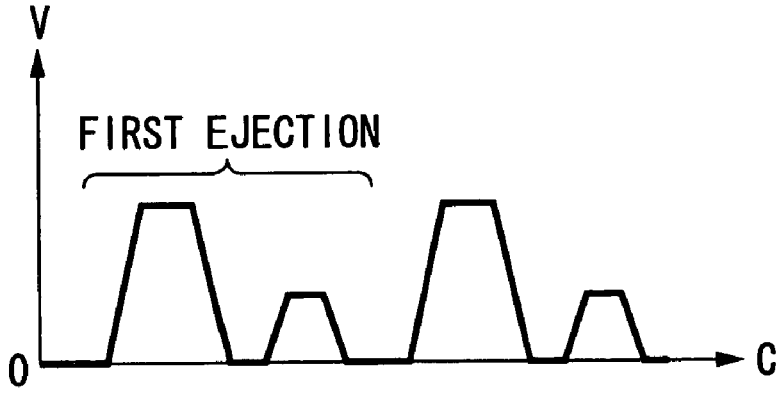

FIG. 8A shows an ejection waveform. The combination of one large peak and one small peak shown in FIG. 8A corresponds to one ejection cycle. Therefore, the waveform shown in FIG. 8A is a waveform representing two ejection cycles.

Figure 8B:
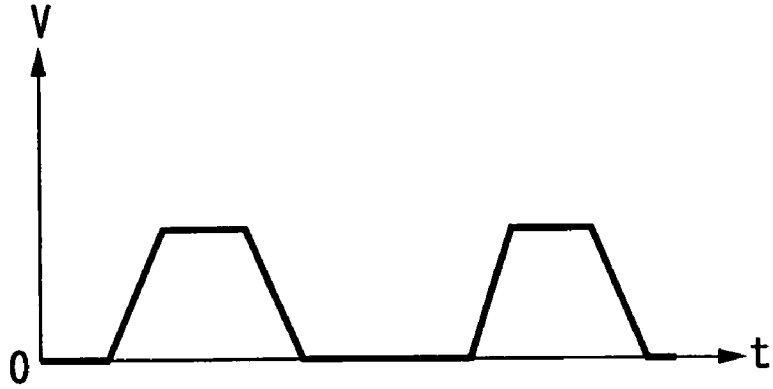

FIG. 8B shows a meniscus shaking waveform. The meniscus shaking waveform has a different amplitude and cycle from the ejection waveform described above, although a waveform of this kind causes the meniscus to shake in such a manner that it does not cause the ink to be ejected. In FIG. 8B, a waveform of this kind which causes shaking without causing ejection is applied in two cycles.

Figure 8C:
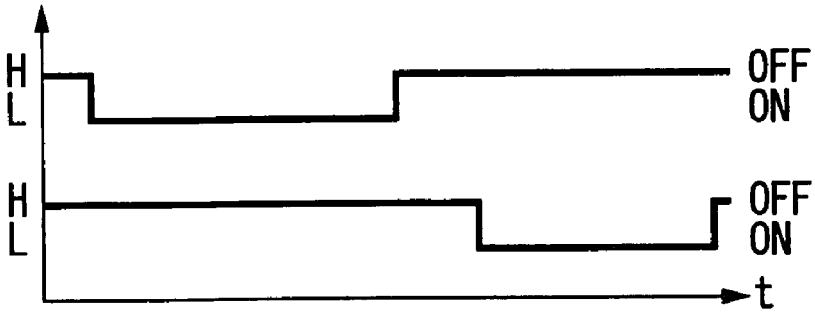

FIG. 8C shows waveforms which select whether ink is to be ejected or whether the ink is to be shaken only without being ejected. The upper waveform in FIG. 8C is a waveform for selecting ejection and the lower waveform is a waveform for selecting meniscus shaking. If either of these waveforms is L (low), then this means that the corresponding waveform is switched on. Consequently, in the example shown in FIG. 8C, since the upper waveform becomes L first, then this waveform switches on and the very first ejection waveform in FIG. 8A is selected. Furthermore, when the lower waveform in FIG. 8C subsequently becomes L, then the second peak of the meniscus shaking signal in FIG. 8B is selected. In this way, FIGS. 8A to 8C show a case where meniscus shaking is carried out after ejection.

Furthermore, in order to select the ejection waveform or the meniscus shaking waveform in this way, a control apparatus 90 and a signal generator 92 are provided, as shown in FIG. 6.

The signal generator 92 is controlled by the control apparatus 90, and by generating an ejection waveform or a meniscus shaking waveform, and by supplying same to the individual electrodes 57 and the diaphragm 56 which also serves as a common electrode, the piezoelectric elements 58 are driven and ejection or meniscus shaking is carried out.

Figure 16:
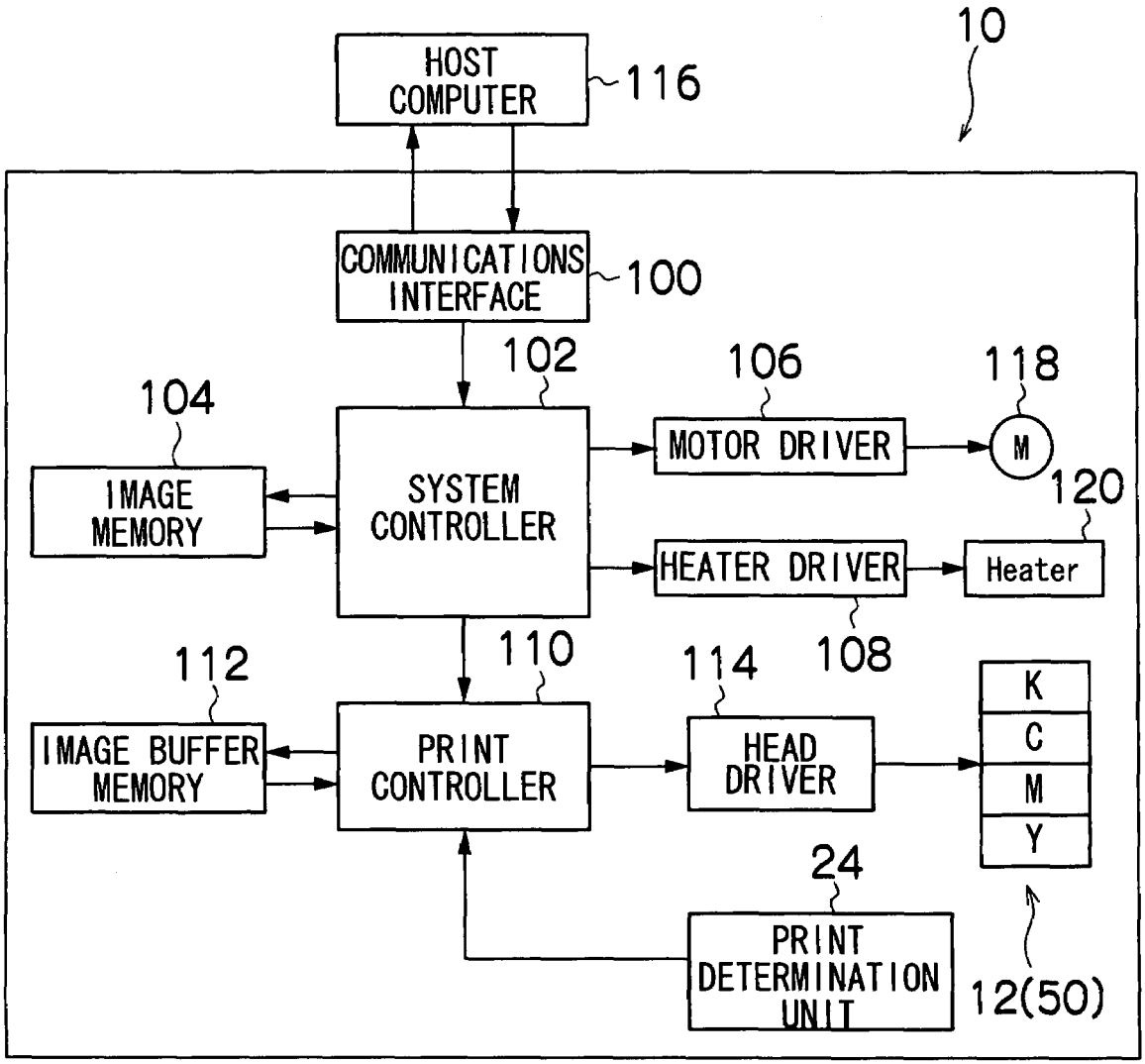
FIG. 16 is a principal block diagram showing the system composition of an inkjet recording apparatus.

FIG. 16 is a principal block diagram showing a system configuration of the inkjet recording apparatus 10. The inkjet recording apparatus 10 comprises a communications interface 100, a system controller 102, an image memory 104, a motor driver 106, a heater driver 108, a print control unit 110, an image buffer memory 112, a head driver 114, and the like.

The communications interface 100 is an interface unit for receiving image data sent from a host computer 116. A serial interface such as USB (Universal Serial Bus), IEEE1394, Ethernet (registered trademark), wireless network, or a parallel interface such as a Centronics interface may be used as the communications interface 100. A buffer memory (not shown) may be mounted in this portion in order to increase the communication speed. The image data sent from the host computer 116 is received by the inkjet recording apparatus 10 through the communications interface 100, and is temporarily stored in the image memory 104. The image memory 104 is a storage device for temporarily storing images inputted through the communications interface 100, and data is written and read to and from the image memory 74 through the system controller 102. The image memory 104 is not limited to a memory composed of semiconductor elements, and a hard disk drive or another magnetic medium may be used.

The system controller 102 is a control unit for controlling the various sections, such as the communications interface 100, the image memory 104, the motor driver 106, the heater driver 108, and the like. The system controller 102 is constituted by a central processing unit (CPU) and peripheral circuits thereof, and the like, and in addition to controlling communications with the host computer 116 and controlling reading and writing from and to the image memory 104, or the like, it also generates a control signal for controlling the motor 118 of the conveyance system and the heater 120.

The motor driver (drive circuit) 106 drives the motor 118 in accordance with commands from the system controller 102. The heater driver 108 drives the heater 120 of the post-drying unit 42 (see FIG. 1) or the like in accordance with commands from the system controller 102.

The print controller 110 has a signal processing function for performing various tasks, compensations, and other types of processing for generating print control signals from the image data stored in the image memory 104 in accordance with commands from the system controller 102 so as to supply the generated print control signal to the head driver 114. Prescribed signal processing is carried out in the print controller 110, and the ejection amount and the ejection timing of the ink droplets from the print unit 12 (the respective print heads 50) are controlled (droplet ejection control is performed) via the head driver 114, on the basis of the print data. By this means, prescribed dot size and dot positions can be achieved. The control apparatus 90 shown in FIG. 6 is included in the print controller 110, and constitutes a portion of the functions of the print controller 110.

The print controller 110 is provided with the image buffer memory 112; and image data, parameters, and other data are temporarily stored in the image buffer memory 112 when image data is processed in the print controller 110. The aspect shown in FIG. 16 is one in which the image buffer memory 112 accompanies the print controller 110; however, the image memory 104 may also serve as the image buffer memory 112. Also possible is an aspect in which the print controller 110 and the system controller 102 are integrated to form a single processor.

The head driver 114 drives the piezoelectric element 58 of the heads of the respective colors 12K, 12C, 12M and 12Y on the basis of print data supplied by the print controller 110. The head driver 114 can be provided with a feedback control system for maintaining constant drive conditions for the respective heads 12K, 12C, 12M and 12Y The signal generator 92 in FIG. 6 is included in the head driver 114, and constitutes a portion of the functions of the head driver 114.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 110. According to requirements, the print controller 110 makes various corrections with respect to the print head 50 on the basis of information obtained from the print determination unit 24.

The system controller 102 and the print controller 110 may be constituted by one processor, and it is also possible to use a device which combines a system controller 102, a motor driver 106, and a heater driver 108, in a single device, or a device which combines a print controller 110 and a head driver 114 in a single device.

In the present embodiment, the mode of the meniscus shaking is devised by altering the manner of selecting the signals indicating an ejection waveform or a meniscus shaking waveform, in such a manner that the air bubbles adhering to the walls of the flow channels detach more readily from the walls.

Figure 9:
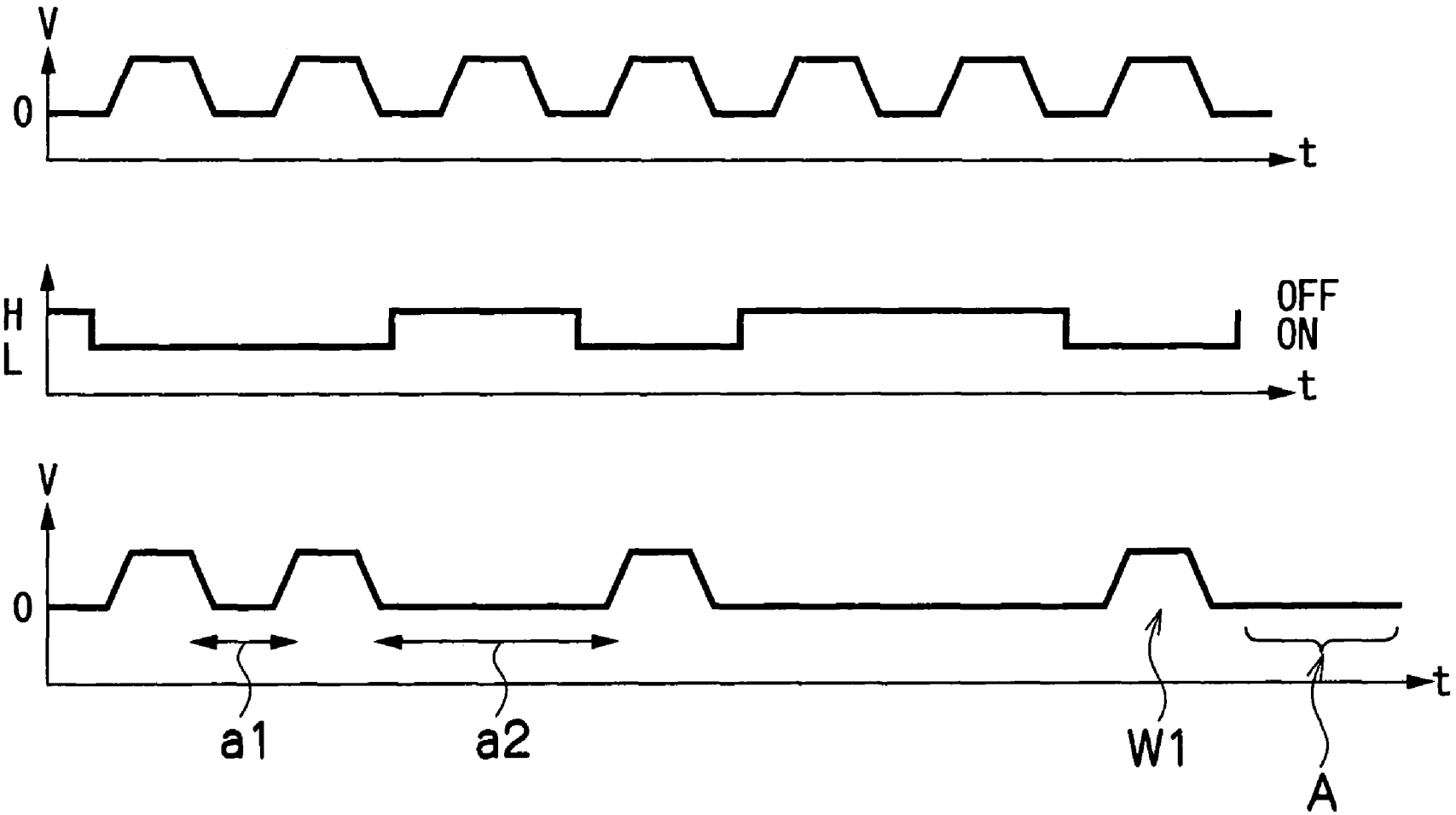
FIG. 9 illustrates graphs showing a meniscus shaking signal according to a first embodiment of the invention.

FIG. 9 shows a mode of selecting the meniscus shaking signal according to the present embodiment. The uppermost waveform in FIG. 9 is a waveform for supplying a meniscus shaking waveform (meniscus shaking waveform supply waveform), in which a waveform of the same width (duration) is output at a uniform cycle. The middle waveform in FIG. 9 is a selection waveform, which switches on when at level "L", and the meniscus shaking supply waveform is selected during the time periods that this signal is at L. In the example shown in FIG. 9, firstly, the two initial peaks in the meniscus shaking waveform are selected, then the subsequent peak is omitted, and then the fourth peak from the start of the meniscus shaking waveform is selected.

In this way, a waveform which fluctuates in such a manner that periodically thinned-out signals are chosen is selected based on the waveform having a uniform cycle which is shown in the uppermost part of FIG. 9. The waveform shown in the lowermost part of FIG. 9 is the shaking waveform for removing air bubbles which results from the process described above and which is actually applied to the piezoelectric elements 58. In this waveform, as indicated by the lowermost waveform in FIG. 9, the shaking intervals a1 and a2 change between longer and shorter intervals. In this way, the applied waveform is one which shakes rapidly and then shakes slowly, and in which these shaking fluctuations also change in a cyclical fashion; therefore, a vibration is applied to the pressure chambers, while varying the cycle at which the air bubbles are shaken, and hence the air bubbles become easier to detach and remove.

Furthermore, in a composition such as that of the present embodiment, in order to remove the air bubbles, the ink may be shaken with greater amplitude than in the meniscus shaking according to the related art. Moreover, there is a possibility that a shaking vibration may continue during ink ejection immediately after vibration.

Therefore, the timing of application of the meniscus shaking signal (which also serves to detach air bubbles) is devised in such a manner that application of the shaking signal is halted for one cycle, in the case of an ink ejection operation which is carried out immediately after shaking. For example, if ink is to be ejected at the timing indicated by the reference symbol A in FIG. 9, then the shaking signal W1 is not applied.

Alternatively, when changing from a shaking signal to an ejection signal, a stabilizing signal which stabilizes the meniscus may be applied immediately after the shaking signal. In actual practice, this involves applying a signal which creates a vibration of the same amplitude and the opposite phase with respect to the shaking at that time.

In the related art technology, detachment of air bubbles during printing is not taken into consideration, but in the present embodiment, air bubble detachment signals are applied continuously during printing, and the drive waveforms are devised in such a manner that stable ejection is achieved.

Figure 7:
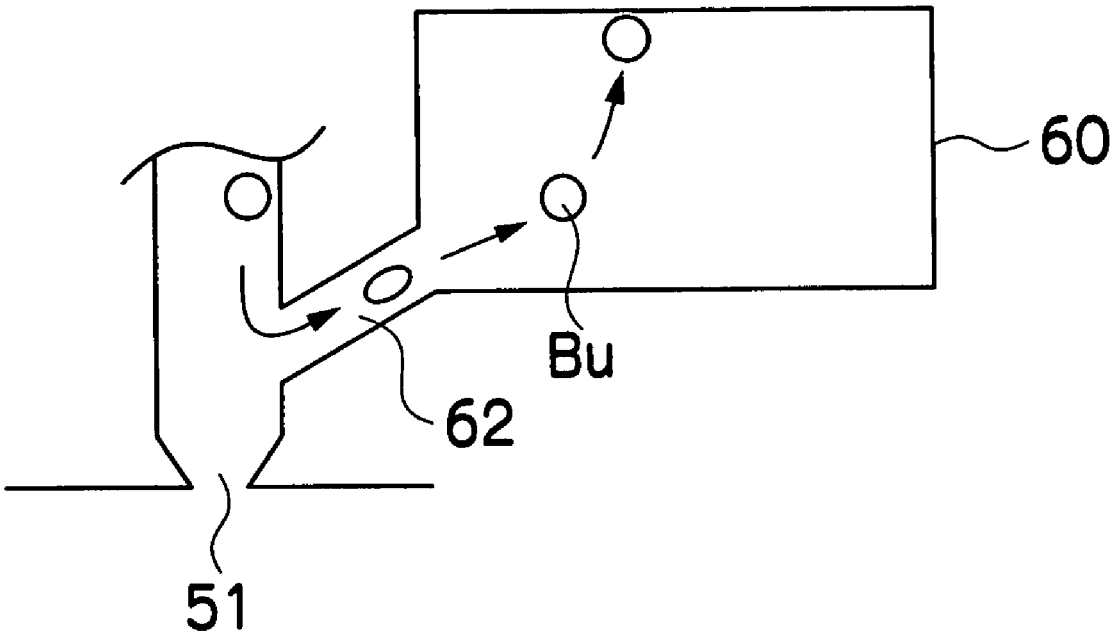
FIG. 7 is an enlarged diagram showing the relationship between a circulation flow channel and a common circulation channel in FIG. 6.

When detaching air bubbles while carrying out printing, as shown in FIG. 6, there is a possibility that air bubbles Bu which have entered into the common circulation channel 60 may flow in reverse via the circulation flow channel 62 and into the pressure chamber 52, due to an ejection operation in that pressure chamber 52 or another pressure chamber 52. Therefore, the common circulation channel 60 has a flow channel space which is located above the circulation flow channels 62, and the air bubbles Bu float up into this space due to buoyancy and are therefore prevented from being sucked into the circulation flow channels 62. Moreover, as shown in FIG. 7, desirably, the circulation flow channels 62 themselves are formed with an upward gradient in such a manner that the common circulation channels 60 are located in a higher position.

Alternatively, in order to impede the reverse flow of air bubbles Bu, it is also possible to create a fast flow of ink in the common circulation channel 60 in such a manner that the air bubbles Bu collected in the common circulation channel 60 flow swiftly. The flow speed in this case is, for example, the same as the flow speed of the common flow channel 55. More specifically, it is desirable that the flow speed should be in the range of approximately one to approximately ten times the ink flow speed when all of the nozzles are ejecting at the maximum rate.

Furthermore, the flow channels in the print head 50 and the walls of the pressure chambers 52 are provided with a surface treatment in order that the angle of contact with respect to the ink is equal to or less than 90°, and more desirably, equal to or less than 30°. By this means, the contact surface area between an air bubble and the wall surface is reduced, and the air bubbles can be detached from the walls more readily when a vibration is applied.

In this way, in the present embodiment, during a printing operation, thinned-out meniscus shaking signals are applied to the nozzles which are not performing ejection, and therefore the shaking frequency of the ink in the pressure chambers can be varied, thereby improving the detachment of air bubbles.

Next, a second embodiment of the present invention is described below.

The composition of the head according to the second embodiment is the same as that of the first embodiment described above, but the present embodiment employs a different waveform for the meniscus shaking signals to cause the air bubbles to detach.

Figure 10:
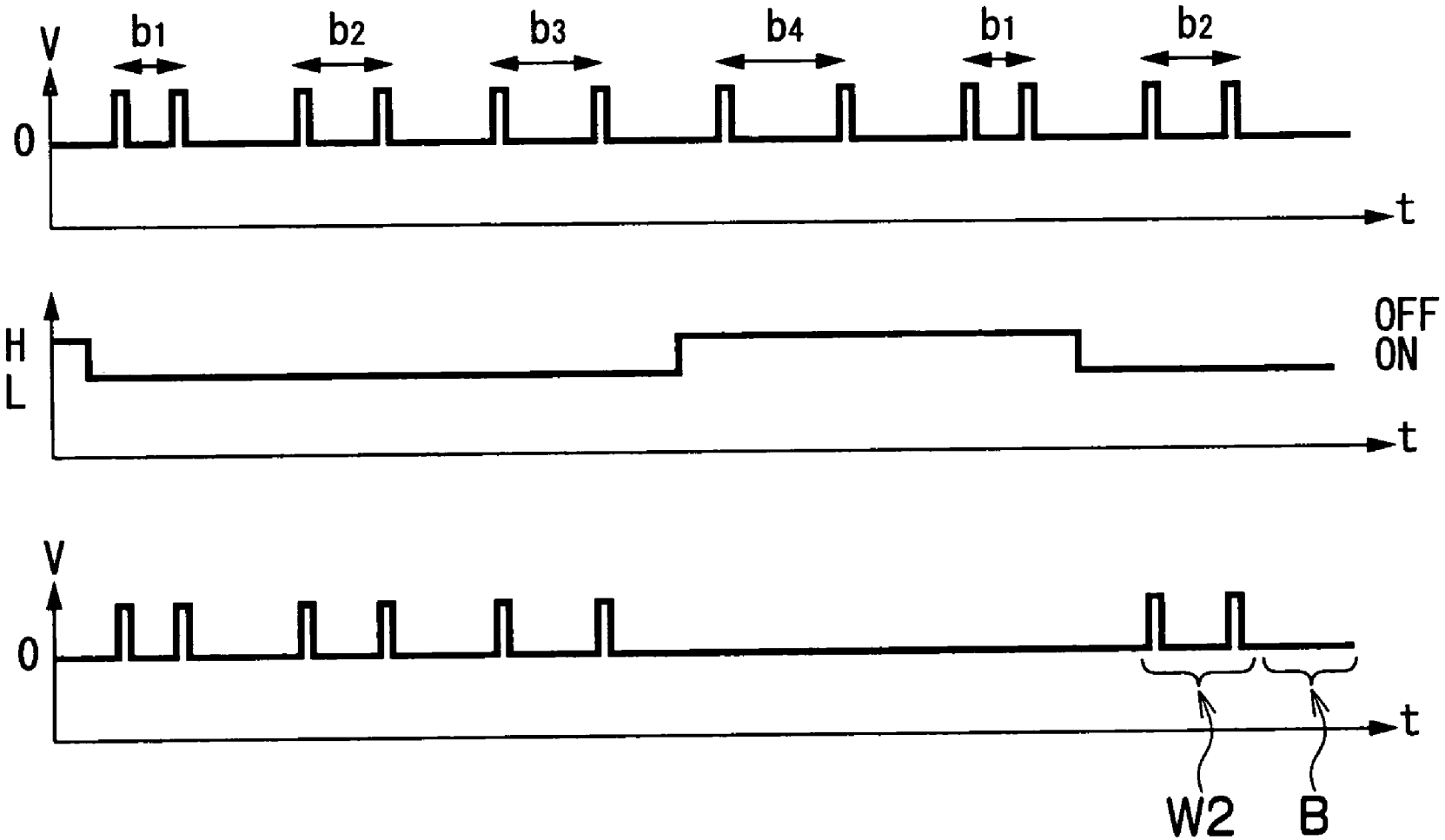
FIG. 10 illustrates graphs showing a meniscus shaking signal according to a second embodiment of the invention.

FIG. 10 shows signal waveforms according to the present embodiment.

As shown by the waveform in FIG. 10, in the present embodiment, the basic waveform is a pulse-shaped waveform in which one shaking waveform has at least two peaks, and the shaking frequency is altered by changing the interval between the pulse waveforms of the two peaks in this basic waveform.

The uppermost waveform in FIG. 10 corresponds to the basic meniscus shaking signals, which comprises a plurality of peaks within one unit cycle, and the intervals b1, b2, b3, b4 between the plurality of peaks are different with respect to each other. The middle waveform in FIG. 10 corresponds to a selection signal which switches on when at level "L", and during the time period that this signal is on, the basic waveform is extracted and applied to the piezoelectric elements 58. Furthermore, the lowermost waveform in FIG. 10 is the actual shaking waveform which is extracted from the basic waveform in this manner.

In the present embodiment, signals having broader and narrower pulse intervals of this kind are applied to the piezoelectric elements 58, and hence the shaking of the meniscus changes progressively.

In this way, since the cycle of shaking the air bubbles is changed within a prescribed range, then according to the drive waveform according to the present embodiment, it is possible to create a meniscus shaking vibration in a broader frequency range than the first embodiment.

Furthermore, in the present embodiment, similarly to the first embodiment, in the case of an ejection signal which occurs immediately after application of the meniscus shaking signal, it is necessary to provide contrivance for halting the application of a shaking signal or for applying a stabilization signal or the like, before the ejection signal. In the present embodiment, since a plurality of pulses are used, then meniscus shaking is carried out at a closer position (timing) to the subsequent ejection driving, in comparison with the first embodiment, and therefore it is particularly important to provide contrivance of this kind.

More specifically, the timing of application of the meniscus shaking signals (which also serves to detach air bubbles) is devised in such a manner that application of the shaking signal is halted for one cycle immediately before the ink ejection operation which is carried out immediately after the shaking. For example, if ink is to be ejected at the timing indicated by the reference symbol B in FIG. 10, then the shaking signal W2 is not applied.

Alternatively, when changing from a shaking signal to an ejection signal, a stabilizing signal which stabilizes the meniscus may be applied immediately after the shaking signal. In actual practice, this involves applying a signal which creates a vibration of the same amplitude and the opposite phase with respect to the shaking at that time.

Furthermore, similarly to the first embodiment, it is also desirable to devise the common circulation channel 60 as shown in FIG. 7, so as to prevent the reverse flow of air bubbles.

In this way, according to the present embodiment, since a plurality of pulses of different intervals for causing meniscus shaking are applied to the nozzles which are not performing ejection, during a printing operation, then it is possible to change the ink shaking frequency in the pressure chambers within a greater range, and therefore the removal of air bubbles can be improved.

Next, a third embodiment of the present invention is described below.

In the present embodiment also, the head composition is similar to that of the first embodiment, but the shaking signal waveform for detaching the air bubbles is different from that of the first embodiment.

Figure 11:
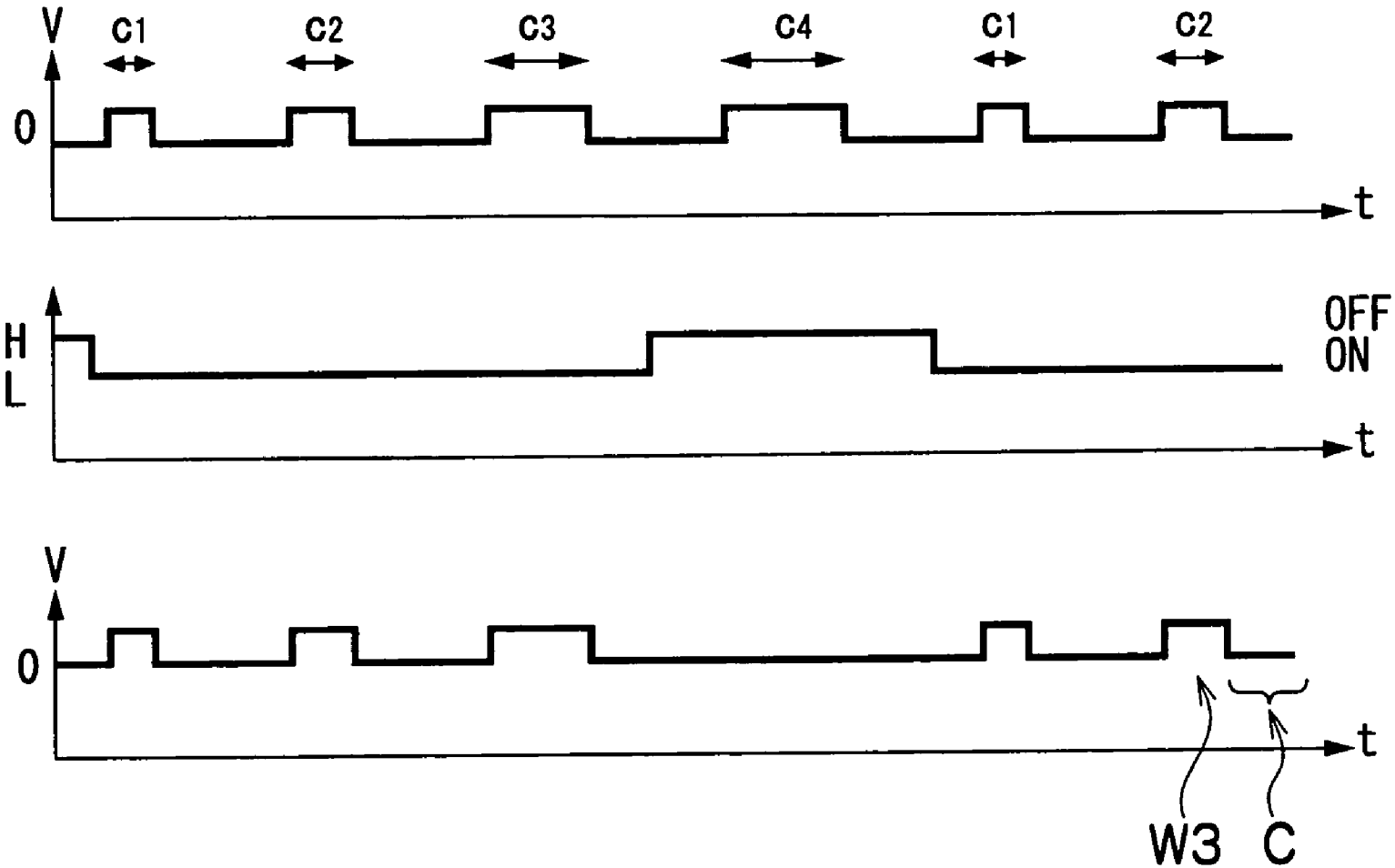
FIG. 11 illustrates graphs showing a meniscus shaking signal according to a third embodiment of the invention.

FIG. 11 shows waveforms according to the present embodiment. The uppermost waveform in FIG. 11 is the basic waveform. As shown in FIG. 11, in the present embodiment, the pulse widths (durations) c1, c2, c3, c4 of trapezoidal (square) waveforms are changed, rather than changing the intervals b1, b2, b3, b4 between a plurality of pulses as in the second embodiment described above. In other words, the pulse widths c1, c2, c3, c4 have mutually different values.

In the present embodiment, a trapezoidal waveform (square signal) is output at a uniform cycle, but by changing the width (duration) of each trapezoid waveform (c1, c2, c3, c4), the mode of shaking is altered. In other words, whereas the second embodiment involves performing two drive operations of a pushing action followed immediately by a return pulling action (a pulse wave having two peaks), in the present embodiment, one pushing action is performed and the wave is held for a while before returning to the original level (one trapezoidal waveform).

In this way, in the present embodiment, the waveform is a trapezoid waveform (square signal), each trapezoid waveform has a width which varies (the widths of the individual pulses (c1, c2, c3, c4)), and therefore it is possible to create a meniscus shaking vibration in a broader frequency range in comparison with the first embodiment. Furthermore, since the waveform is a trapezoidal waveform, then compared to the second embodiment, it is possible to maintain the pressurization or depressurization of the ink throughout a certain time period, and therefore a large vibration can be applied readily.

Furthermore, in the present embodiment, in the case of an ejection signal which is issued after meniscus shaking, similarly to the first embodiment, it is necessary to provide contrivance for halting the application of the shaking signal or applying a stabilization signal, or the like. In the present embodiment, since the pulse width is varied, then driving of meniscus shaking is carried out at a closer position (timing) to the subsequent ejection driving, in comparison with the first embodiment, and therefore it is particularly important to provide the contrivance as described above.

More specifically, the timing of application of the meniscus shaking signal (which also serves to detach air bubbles) is devised in such a manner that application of the shaking signal is halted for one cycle immediately before the ink ejection operation which is carried out immediately after shaking. For example, if ink is to be ejected at the timing indicated by the reference symbol C in FIG. 11, then the shaking signal W3 is not applied.

Alternatively, when changing from a shaking signal to an ejection signal, a stabilizing signal which stabilizes the meniscus may be applied immediately after the shaking signal. In actual practice, this involves applying a signal which creates a vibration of the same amplitude and the opposite phase with respect to the shaking at that time.

Moreover, in the present embodiment, it is desirable to devise the common circulation channel 60 as shown in FIG. 7 in order to prevent the reverse flow of air bubbles.

In this way, according to the present embodiment, since pulses of different widths for causing meniscus shaking are applied to the nozzles which are not performing ejection, during a printing operation, then it is possible to change the ink shaking frequency in the pressure chambers within a greater range, and to achieve a greater amplitude in the shaking vibration, and therefore the removal of air bubbles can be improved.

Next, a fourth embodiment of the present invention is described below.

The fourth embodiment is one where, when the cycle at which the air bubbles are shaken is changed within a prescribed frequency range in the second embodiment and the third embodiment described above, in the case of a drive signal having vibration conditions which are close to the original resonance frequency of the pressure chambers, the amplitude is reduced in comparison with other frequencies, and is generally set to an amplitude of ⅓ to ½ with respect to the amplitude at the frequencies before or after the resonance frequency where the amplitude is not reduced.

Consequently, the shake amount of the ink is reduced, the greater vibration can be applied while unintentional ejection caused by the meniscus shaking signal is prevented, and hence the air bubble removal characteristics can be improved.

Figure 12:
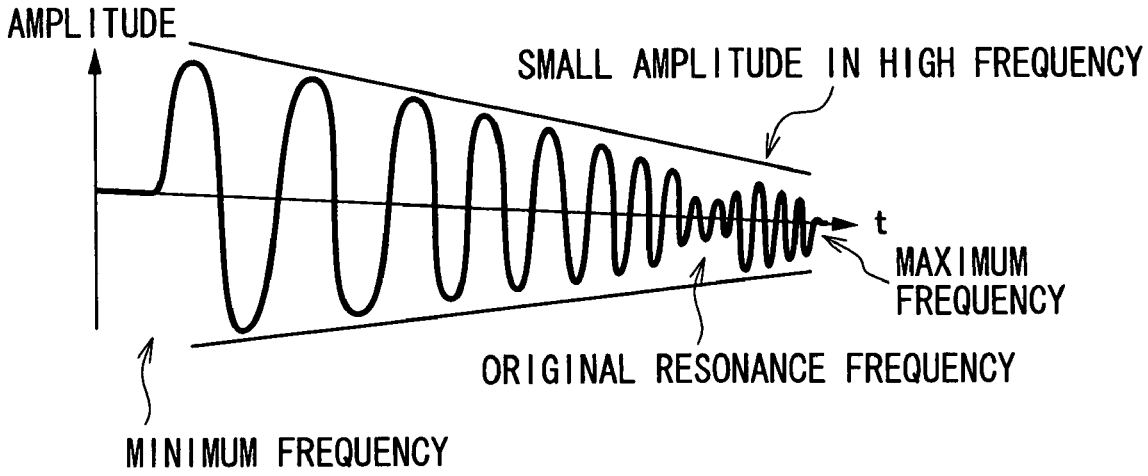
FIG. 12 is a graph showing an image of a waveform according to a fourth embodiment of the invention.

FIG. 12 shows an image of the present embodiment. As shown in FIG. 12, this is a continuous image in which the frequency changes progressively from a low frequency to a high frequency, and the amplitude is reduced sharply in the vicinity of the original resonance frequency of the pressure chambers. The reason for this is as follows. If an air bubble has entered into a pressure chamber 52, then the resonance frequency of the pressure chamber diverges from the original resonance frequency, but due to compliance of the air bubble, ejection becomes less liable to occur and there is no problem if a large vibration is applied. However, since the resonance frequency has diverged from the original resonance frequency, then it is considered that reducing the amplitude will have little effect on the expulsion of air bubbles, but on the other hand, have a significant beneficial effect in preventing the occurrence of unintentional ejection.

Figure 13A:
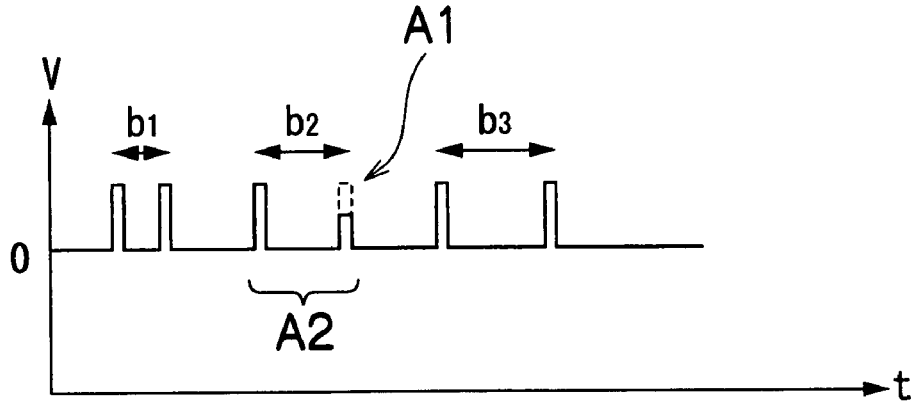
FIGS. 13A and 13B are illustrative diagrams showing the actual applied waveforms according to the fourth embodiment, wherein FIG. 13A corresponds to the second embodiment and FIG. 13B corresponds to the third embodiment.
Figure 13B:
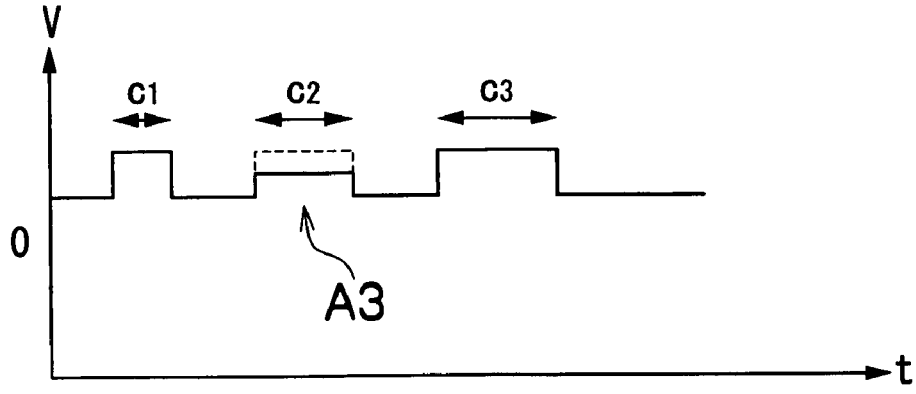

FIGS. 13A and 13B show actual application waveforms according to the present embodiment. FIG. 13A corresponds to the second embodiment and FIG. 13B corresponds to the third embodiment.

As shown in FIG. 13A, in the case of the second embodiment, for example, the signal in the portion indicated by the arrow A1 in FIG. 13A is reduced to approximately ½. Alternatively, the two pulse waveforms included in the bracket A2 may be both reduced.

Furthermore, in the case of the third embodiment, as shown in FIG. 13B, the output of the trapezoidal waveform indicated by the arrow A3 in FIG. 13B is reduced to approximately ½. Instead of reducing the output in this way, it is also possible to make the rise and fall of the trapezoid waveform more gradual.

Next, a fifth embodiment of the present invention is described below.

The present embodiment specifies a range of frequency change, as described below, in such a manner that a signal having this frequency range is applied in the first to fourth embodiments described above.

Range of Frequency Change (1) The maximum diameter of the bubbles entering into the pressure chambers is substantially equal to the mesh size of the filter on the ink supply side.

(2) The minimum diameter of the bubbles is the minimum size of a bubble which would affect ejection (generally about 5 to 10 μm, although this depends on the ink viscosity and the original resonance frequency of the pressure chambers).

(3) If there are bubbles in the vicinity of the ink supply ports (first restrictors), in the vicinity of the circulation flow channels (second restrictors), in the pressure chambers, or in the vicinity of the nozzles, then within the air bubble size range stated in (1) and (2) above, the resonance frequency related to the pressure chambers including the ink and the air bubbles, is determined by a lumped constant method.

Here, the condition (3) above may be determined experimentally. For example, the conditions required to detach air bubbles are obtained, by actually injecting bubbles in the size range indicated by the above conditions (1) and (2) into the pressure chambers, then by applying a drive signal frequency to the piezoelectric elements (actuators) under the ink circulation speed conditions wherein the circulation speed is not sufficient to remove the bubbles by means of the circulating flow alone, and then by varying the frequency of the signal.

By causing the ink to vibrate in a concentrated fashion within a specified frequency range in this way, it is possible to detach the air bubbles in a shorter time.

The frequency varies greatly with the dimensions of the respective parts of the head and the characteristics of the ink, but in general, it is in the range of several kHz to several MHz, which is an extremely broad range. Therefore, it is desirable to narrow the frequency range used for vibration, as described previously.

Next, a sixth embodiment of the present invention is described below.

The present embodiment is one where, in the embodiments described above, the signal change in the meniscus shaking signal is made gradual in the case of the pressurizing action, and the signal change is made sharp in the case of the depressurizing action. Thereby, since the air bubbles are caused to expand suddenly, the air bubble detaching force can act in an effective manner and therefore the air bubbles become more liable to detach.

Furthermore, in the present embodiment, the relationship between the ink supply ports (first restrictors) and the circulation flow channels (second restrictors) is such that (resistance of first restrictor/resistance of second restrictor)>(inertance of first restrictor/inertance of second restrictor).

As a result of this, the flow rates in the respective restrictors during pressurization and depressurization have the following relationship: (flow rate in first restrictor during pressurization/flow rate in second restrictor during pressurization)< (flow rate in first restrictor during depressurization/flow rate in second restrictor during depressurization) . . . Formula (1).

Moreover, in this state, since the push and pull actions are performed under conditions which do not lead to the ink ejection, then the following relationship is also established: (flow rate in first restrictor during pressurization)+(flow rate in second restrictor during pressurization)=(flow rate in first restrictor during depressurization)+(flow rate in second restrictor during depressurization) . . . Formula (2).

Therefore, the following Formula (3) is satisfied: (flow rate in first restrictor during depressurization)−(flow rate in first restrictor during pressurization)>0 . . . Formula (3), which means that the intake from the first restrictor is larger.

Furthermore, the following Formula (4) is satisfied: (flow rate in second restrictor during depressurization)−(flow rate in second restrictor during pressurization)<0 . . . Formula (4), which means that the output from the second restrictor is larger.

This can be demonstrated in the following way.

The relationships stated in Formula (3) and Formula (4) above can be demonstrated as below.

Firstly, in order to simplify the expressions, the flow rate in the first restrictor during pressurization is represented as "a", the flow rate in the second restrictor during pressurization is represented as "b", the flow rate in the first restrictor during depressurization is represented as "c", and the flow rate in the second restrictor during depressurization is represented as "d". The signs a, b, c and d are all positive values.

If Formulas (1) and (2) above are represented using this notation, then the following expressions are obtained.

$$a/b<c/d \quad \text{Formula (1)}$$

$$a+b=c+d \quad \text{Formula (2)}$$

Here, the following relationship is derived from Formula (2), c−a=−(d−b).

Therefore, "c−a" and "d−b" are either the same value of different polarity, or are both equal to zero.

Firstly, supposing that c−a=0, and d−b=0, then c=a and b=d. In this case, Formula (1) would become a/b<a/b which is a contradiction. Therefore, "c−a" and "d−b" are not equal to zero.

Next, it is assumed that c−a<0, and d−b>0. Furthermore, supposing, here, that a=c+α(α>0), and d=b+β(β>0), then from Formula (1), the following expression is established.

$$(c+\alpha)/b<c/(b+\beta)$$

Therefore, (c+α)·(b+β)<bc, and since here α>0 and β>0, and also b>0 and c>0, then this assumption also presents a contradiction.

Finally, Formula (3) and Formula (4) are considered. In other words, it is supposed that the following relationships are established.

$$c-a>0 \quad \text{Formula (3)}$$

$$d-b<0 \quad \text{Formula (4)}$$

Here, if c=a+γ(γ>0) and b=d+δ(δ>0), then from Formula (1), the following relationship is established.

$$a/(d+\delta)<(a+\gamma)/d$$

Therefore, the following relationship is established: a·d< (a+γ)·(d+δ). Here, since γ>0, δ>0, a>0 and d>0, then this assumption is not a contradiction. The relationship between "c−a" and "d−b" satisfies all of the conditions above, and therefore as stated previously, Formula (3) and Formula (4) are established.

Consequently, the results described above are obtained, the flow rates vary in the respective restrictor sections during the push and pull actions, and therefore a unidirectional flow is created. Accordingly, it is also possible to obtain beneficial effects in promoting a circulating flow.

Figure 14A:
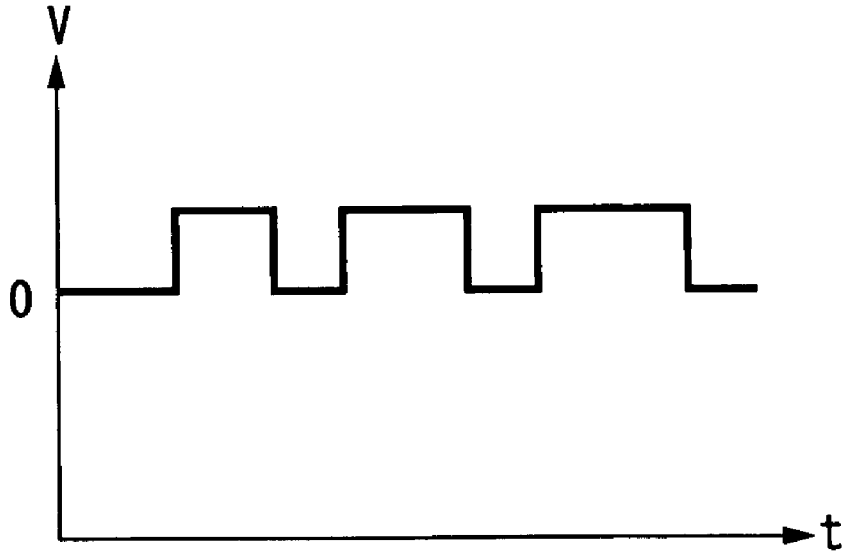
FIGS. 14A and 14B are graphs showing applied waveforms according to a sixth embodiment.
Figure 14B:
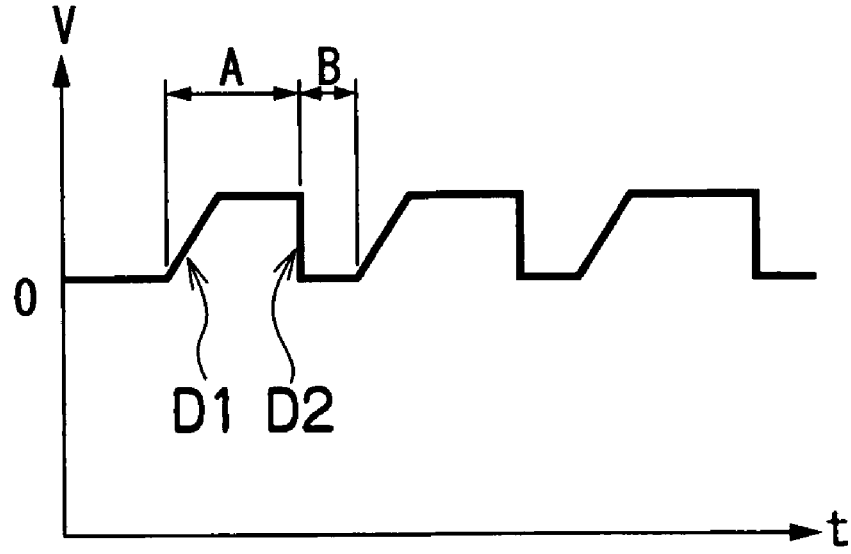

FIGS. 14A and 14B show one example of signal control according to the present embodiment.

FIG. 14A is a waveform according to the third embodiment described previously. On the other hand, in the present embodiment, as shown in FIG. 14B, the rising edge D1 of the trapezoidal waveform changes gradually, while the falling edge D2 changes suddenly. Thereby, the gas bubble detachment effects are improved.

Moreover, by making the time A from the rising edge D1 until the falling edge D2 longer than the time B from the falling edge D2 until the (next) rising edge D1, a greater amount of ink is made to flow out from the second restrictor during pressurization, due to the inertial force of the ink, thereby further promoting the circulating flow described above.

As described above, according to the present embodiment, the resistances and the inertances of the ink supply restrictors of the pressure chambers and the restrictors of the circulation channels are set to a prescribed relationship, and furthermore, the rates of change of the shaking signal are different in the rising edge and the falling edge. Therefore, the air bubble removal characteristics are improved and a flow which promotes ink circulation is obtained.

Next, a seventh embodiment of the present invention is described below.

In the present embodiment, a high-frequency signal which causes the air bubbles to vibrate in a high-order mode is applied simultaneously with the basic signal for meniscus shaking, in such a manner that air bubbles are caused to detach while promoting the dissolution of the air bubbles into the ink by increasing the surface area of the air bubbles. In other words, the present embodiment has beneficial effects of simultaneously promoting detachment of air bubbles and dissolution of the air bubbles into the ink.

Since the air bubbles become smaller in size, then the resonance frequency of the air bubbles becomes higher; therefore, the basic signal for meniscus shaking is changed accordingly, from a lower frequency to a higher frequency.

Figure 15A:
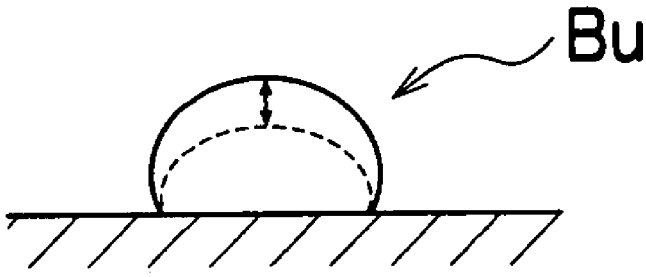
Figure 15B:
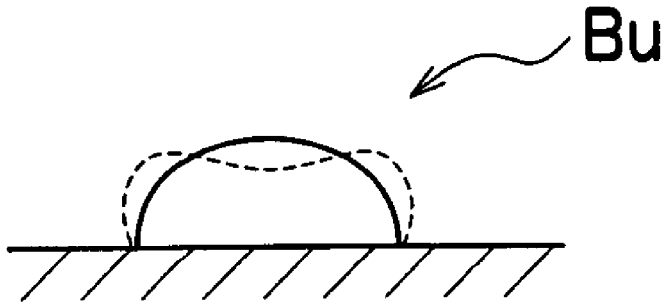
Figure 15C:
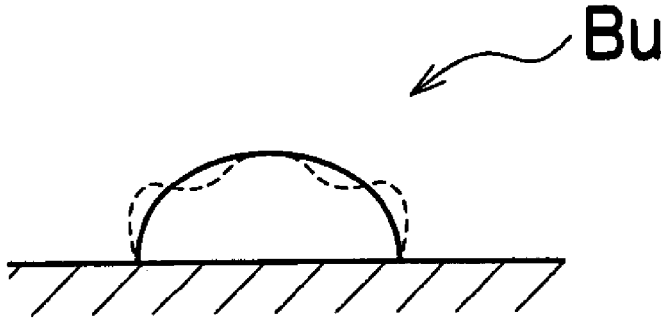

FIGS. 15A to 15C show states of the detachment and dissolution of an air bubble according to the present embodiment.

FIG. 15A shows the state of an air bubble Bu which is adhering to the wall of a flow channel, in a case where a normal push-pull meniscus shaking signal is being applied. In the case of a normal push-pull signal, as shown in FIG. 15A, the surface of the air bubble Bu deforms to a similar shape, while maintaining a spherical surface.

On the other hand, when a signal of higher frequency is applied, the air bubble Bu vibrates in a higher order, either in the high-order mode 1 shown in FIG. 15B or the high-order mode 2 shown in FIG. 15C, and deforms as indicated by the dotted lines in FIG. 15B and FIG. 15C, thereby increasing the detaching force acting on the air bubble Bu. Furthermore, since the surface area of the air bubble Bu also increases simultaneously, then if the ink surrounding the air bubble Bu has been deaerated in this case, it can be expected that the air bubble Bu dissolves into the ink.

In this way, according to the present embodiment, by making air bubbles vibrate in a high-order mode, a beneficial effect is obtained in that the air bubbles can be made to dissolve at the same time as causing the air bubbles to become detached.

Below, a concrete example of the present embodiment is described. The order of the vibration occurring in the surface of a very small air bubble when a pressure vibration of small amplitude is applied depends on the vibration that is applied, but it can be determined by means of Formula (5) below.

$$\lambda = \sqrt[3]{\frac{2\pi\sigma}{\rho f_k^2}} = \sqrt[3]{\frac{8\pi\sigma}{\rho f_e^2}} \qquad \text{Formula (5)}$$

The symbols used in Formula (5) have the following meanings.

$\lambda$: vibration wavelength generated in surface of very small air bubble (m)

$\sigma$: surface tension (for example, 30 mN/m)

$\rho$: density (for example, 1000 kg/m$^3$)

$f_k$: frequency of vibration generated in surface of very small bubble (Hz)

$f_e$: frequency of applied vibration (Hz)

Here, the wavelength of the high-order mode 1 shown in FIG. 15B is substantially ¼ of the length of the circumference of the air bubble. Furthermore, the wavelength of the high-order mode 2 shown in FIG. 15C is substantially ⅙ of the length of the circumference of the air bubble.

On the other hand, the size of the air bubble can be envisaged in the following terms, as described in the fifth embodiment.

(1) The maximum diameter of the bubbles entering into the pressure chambers is substantially equal to the mesh size of the filter on the ink supply side.

(2) The minimum diameter of the bubbles is the minimum size of a bubble which would affect ejection (generally about 5 to 10 μm, although this depends on the ink viscosity and the original resonance frequency of the pressure chambers).

Since the size of the mesh of the filter in the above condition (1) is generally equal to or less than the size of the nozzle, in order to prevent nozzle blockages caused by foreign matter, then here the mesh size is taken to be 25 μm. In other words, a small air bubble has a size of 5 μm and a large air bubble has a size of 25 μm.

Under these conditions, if the relationship between the wavelengths of the high-order mode 1 and the high-order mode 2 described above, and the frequency of the applied vibration, is determined, then the following relationships are obtained.

Firstly, if the air bubble has a size of 5 μm, and if the wavelength is ¼ of the length of the circumference of the air bubble, then the wavelength $\lambda$ is as shown in Formula (6) below.

$$\lambda = 5\cdot\pi/4 \approx 4\ (\mu m) \qquad \text{Formula (6)}$$

Furthermore, rearranging Formula (5) on the basis of the item after the second equals sign in Formula (1), the following equation, Formula (7), is obtained.

$$f_e = \sqrt{\frac{8\pi\sigma}{\rho\lambda^3}} \qquad \text{Formula (7)}$$

Therefore, $f_e$ is as shown in Formula (8) below.

$$f_e \approx 3.43\ (MHz) \qquad \text{Formula (8)}$$

Furthermore, if the wavelength is ⅙ of the length of the circumference of the bubble, then the wavelength $\lambda$ is as given in Formula (9) below.

$$\lambda = 5\cdot\pi/6 \approx 2.6\ (\mu m) \qquad \text{Formula (9)}$$

Moreover, similarly to the foregoing, $f_e$ can be obtained as shown in Formula (10) below.

$$f_e \approx 6.55\ (MHz) \qquad \text{Formula (10)}$$

Furthermore, if the air bubble has a size of 25 μm, then if the wavelength is ¼ of the length of the circumference of bubble, the wavelength $\lambda$ is as shown in Formula (11) below, and $f_e$ is as shown in Formula (12) below.

$$\lambda = 25\cdot\pi/4 \approx 20\ (\mu m) \qquad \text{Formula (11)}$$

$$f_e \approx 0.307\ (MHz) \qquad \text{Formula (12)}$$

Furthermore, in this case, if the wavelength is ⅙ of the length of the circumference of the bubble, then the wavelength $\lambda$ is as given in Formula (13) below, and $f_e$ is as given in Formula (14) below.

$$\lambda = 25\cdot\pi/6 \approx 13\ (\mu m) \qquad \text{Formula (13)}$$

$$f_e \approx 0.586\ (MHz) \qquad \text{Formula (14)}$$

From the results described above, the lowest frequency $f_e$ and the highest frequency $f_e$ are respectively as shown in Formula (15) and Formula (16) below.

$$f_e \approx 0.307\ (MHz) \qquad \text{Formula (15)}$$

$$f_e \approx 6.55\ (MHz) \qquad \text{Formula (16)}$$

These frequencies relate to a case where the wavelength of the vibration occurring in the surface of the small air bubble is substantially governed with respect to the size of the air bubble, and therefore the actual wavelengths of the actual high-order mode 1 and high-order mode 2 are expected to diverge to a greater or lesser extent from these values.

Furthermore, even in the case of air bubbles having the same volume, the state of vibration varies depending on whether or not the bubble is in contact with the wall of a pressure chamber, or on the contact surface area if the bubble is in contact with the wall of a pressure chamber. Therefore, it is desirable to apply a vibration through a somewhat broader frequency range than the frequency range described above.

However, as can be seen from the frequencies calculated above, if the frequency of the applied vibration is approximately doubled, then the vibration changes to a vibration mode of the next higher order, and therefore it is not necessary for the lower frequency to be set below ½ of the frequency range given above.

Moreover, since bubbles of less than 5 μm in size do not affect ejection, then in a similar fashion, it is not necessary to raise the higher frequency by a considerable amount.

Consequently, to allow spare margins, it is sufficient to reduce the lower frequency by ½ of the frequency range given above, and to raise the higher frequency by some 10 to 20% of the frequency range given above.

In other words, the frequency range is set to 0.15 to 7 MHz.

Inkjet recording apparatuses according to the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

pressure chambers connected via nozzle flow channels to nozzles which eject ink;

ink supply ports via which the ink is supplied to the pressure chambers;

a circulation flow channel which is connected to the nozzle flow channels and via which the ink from the pressure chambers is circulated;

actuators which changes pressure in the pressure chambers to eject the ink from the nozzles;

a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, continuous meniscus shaking signals causing the ink in the nozzles to shake to an extent which does not lead the ink to be ejected, wherein the control apparatus thins out the meniscus shaking signals applied to the actuators for the pressure chambers in which the ink is not ejected at a plurality of different cycles.

2. An inkjet recording apparatus, comprising:

pressure chambers connected via nozzle flow channels to nozzles which eject ink;

ink supply ports via which the ink is supplied to the pressure chambers;

a circulation flow channel which is connected to the nozzle flow channels and via which the ink from the pressure chambers is circulated;

actuators which changes pressure in the pressure chambers to eject the ink from the nozzles;

a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, meniscus shaking signals each of which includes a plurality of pulse signals within one unit cycle and which cause the ink in the nozzles to shake to an extent which does not lead the ink to be ejected, wherein the control apparatus applies the meniscus shaking signals to the actuators for the pressure chambers in which the ink is not ejected in such a manner that time intervals between the plurality of pulse signals within one unit cycle of each of the meniscus shaking signals are altered sequentially.

3. An inkjet recording apparatus, comprising:

pressure chambers connected via nozzle flow channels to nozzles which eject ink;

ink supply ports via which the ink is supplied to the pressure chambers;

a circulation flow channel which is connected to the nozzle flow channels and via which the ink from the pressure chambers is circulated;

actuators which changes pressure in the pressure chambers to eject the ink from the nozzles;

a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, meniscus shaking signals each of which include a square wave within one unit cycle and which cause the ink in the nozzles to shake to an extent which does not lead the ink to be ejected, wherein the control apparatus applies the meniscus shaking signals to the actuators for the pressure chambers in which the ink is not ejected in such a manner that duration of the square wave within one unit cycle is altered sequentially.

4. The inkjet recording apparatus as defined in claim 1, wherein, when vibration of the ink caused by controlling the meniscus shaking signals has conditions close to a resonance frequency of the pressure chambers, amplitude of the meniscus shaking signals is reduced in comparison with the amplitude of the meniscus shaking signals at other frequencies.

5. The inkjet recording apparatus as defined in claim 2, wherein, when vibration of the ink caused by controlling the continuous meniscus shaking signals has conditions close to a resonance frequency of the pressure chambers, amplitude of the meniscus shaking signals is reduced in comparison with the amplitude of the meniscus shaking signals at other frequencies.

6. The inkjet recording apparatus as defined in claim 3, wherein, when vibration of the ink caused by controlling the continuous meniscus shaking signals has conditions close to a resonance frequency of the pressure chambers, amplitude of the meniscus shaking signals is reduced in comparison with the amplitude of the meniscus shaking signals at other frequencies.

7. The inkjet recording apparatus as defined in claim 1, wherein:

the control apparatus applies the meniscus shaking signals to the actuators for the pressure chambers in which the ink is not ejected in such a manner that vibration of a frequency range causing resonance of the pressure chambers including an air bubble in a size range which allows the air bubble to enter into the pressure chambers occurs; and a maximum size of the air bubble is taken to be a mesh size of a filter provided on the ink supply port side, and a minimum size of the air bubble is taken to be a size of a smallest air bubble which has an effect on ejection of the ink.

8. The inkjet recording apparatus as defined in claim 2, wherein:

the control apparatus applies the meniscus shaking signals to the actuators for the pressure chambers in which the ink is not ejected in such a manner that vibration of a frequency range causing resonance of the pressure chambers including an air bubble in a size range which allows the air bubble to enter into the pressure chambers occurs; and a maximum size of the air bubble is taken to be a mesh size of a filter provided on the ink supply port side, and a minimum size of the air bubble is taken to be a size of a smallest air bubble which has an effect on ejection of the ink.

9. The inkjet recording apparatus as defined in claim 3, wherein:

the control apparatus applies the meniscus shaking signals to the actuators for the pressure chambers in which the ink is not ejected in such a manner that vibration of a frequency range causing resonance of the pressure chambers including an air bubble in a size range which allows the air bubble to enter into the pressure chambers occurs; and a maximum size of the air bubble is taken to be a mesh size of a filter provided on the ink supply port side, and a minimum size of the air bubble is taken to be a size of a smallest air bubble which has an effect on ejection of the ink.

10. An inkjet recording apparatus, comprising:

pressure chambers connected via nozzle flow channels to nozzles which eject ink;

ink supply ports via which the ink is supplied to the pressure chambers;

a circulation flow channel which is connected to the nozzle flow channels and via which the ink from the pressure chambers is circulated;

actuators which changes pressure in the pressure chambers to eject the ink from the nozzles;

a circulating flow generation device which generates a circulating flow of the ink in such a manner that the ink flows from an ink supply port side to a circulation flow channel side, even when the ink is ejected from the nozzles to perform recording; and a control apparatus which, during the recording, applies ink ejection signals to the actuators for the pressure chambers in which the ink is ejected, and applies, to the actuators for the pressure chambers in which the ink is not ejected, meniscus shaking signals which cause the ink in the nozzles to shake to an extent which does not lead the ink to be ejected, wherein a following relationship is satisfied:

(resistance of the ink supply port/resistance of the circulation flow channel) >(inertance of the ink supply port/inertance of the circulation flow channel); and wherein, with respect to the meniscus shaking signals, an absolute value of an average amount of change per unit time when the pressure in the pressure chambers is reduced is made larger than an absolute value of an average amount of change per unit time when the pressure in the pressure chambers is increased.

11. The inkjet recording apparatus as defined in claim 7, wherein high-frequency signals causing the air bubble to vibrate in a high-order mode are applied to the actuators for the pressure chambers in which the ink is not ejected, simultaneously with the meniscus shaking signals.

12. The inkjet recording apparatus as defined in claim 8, wherein high-frequency signals causing the air bubble to vibrate in a high-order mode are applied to the actuators for the pressure chambers in which the ink is not ejected, simultaneously with the meniscus shaking signals.

13. The inkjet recording apparatus as defined in claim 9, wherein high-frequency signals causing the air bubble to vibrate in a high-order mode are applied to the actuators for the pressure chambers in which the ink is not ejected, simultaneously with the meniscus shaking signals.

14. The inkjet recording apparatus as defined in claim 10, wherein high-frequency signals causing an air bubble in the pressure chambers or in a neighborhood of the pressure chambers to vibrate in a high-order mode are applied to the actuators for the pressure chambers in which the ink is not ejected, simultaneously with the meniscus shaking signals.

* * * * *